US008056601B2

(12) United States Patent
Kirby et al.

(10) Patent No.: US 8,056,601 B2
(45) Date of Patent: Nov. 15, 2011

(54) SELF-CONTAINED TENSIONED ROLLER SHADE SYSTEM

(75) Inventors: David A. Kirby, Zionsville, PA (US); Jason C. Killo, Emmaus, PA (US); David William Petrillo, Pennington, NJ (US); Fabian Brugger, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 677 days.

(21) Appl. No.: 12/061,802

(22) Filed: Apr. 3, 2008

(65) Prior Publication Data

US 2009/0229769 A1 Sep. 17, 2009

Related U.S. Application Data

(60) Provisional application No. 61/035,911, filed on Mar. 12, 2008.

(51) Int. Cl.
*E06B 9/40* (2006.01)

(52) U.S. Cl. ..... 160/265; 160/279; 160/322

(58) Field of Classification Search ..... 160/265, 160/279, 322, 84.06, 282, 284, 285, 287
See application file for complete search history.

(56) References Cited

U.S. PATENT DOCUMENTS

| | | | | |
|---|---|---|---|---|
| 490,448 | A * | 1/1893 | Lugrin | 160/120 |
| 1,121,898 | A * | 12/1914 | Davis | 160/265 |
| 1,134,326 | A * | 4/1915 | Gambon | 160/277 |
| 2,383,015 | A | 8/1945 | Pratt | |
| 3,386,489 | A | 6/1968 | Denton et al. | |
| 3,522,834 | A * | 8/1970 | Corcoran | 160/23.1 |
| 4,252,172 | A * | 2/1981 | Pommat et al. | 160/322 |
| 4,715,583 | A | 12/1987 | Grutzner | |
| 4,807,683 | A | 2/1989 | Hennequin et al. | |

(Continued)

FOREIGN PATENT DOCUMENTS

DE 8522704 U1 10/1985

(Continued)

OTHER PUBLICATIONS

European Patent Office, International Search Report and Written Opinion for International Patent Application No. PCT/US2009/036456, Sep. 28, 2009, 17 pages.

(Continued)

*Primary Examiner* — David Purol
(74) *Attorney, Agent, or Firm* — Mark E. Rose; Philip N. Smith; Bridget L. McDonough

(57) ABSTRACT

A self-contained tensioned roller shade system that can be easily installed in an opening, such as a window or a skylight. The roller shade system comprises a free-standing frame, a roller tube rotatably mounted between first and second side channels of the frame adjacent a first end of the frame, and a shade fabric is windingly received around the roller tube. A tensioning cord is operatively coupled between the roller tube and a second fabric end opposite the first fabric end, and is windingly received about the roller tube. A pulley is operatively coupled to the frame adjacent the second frame end and windingly receives the tensioning cord. The tensioning cord is adapted to bias the second fabric end toward the second frame end, the second fabric end of the shade fabric adapted to move between the first and second frame ends as the roller tube is rotated.

30 Claims, 15 Drawing Sheets

U.S. PATENT DOCUMENTS

| | | | | | |
|---|---|---|---|---|---|
| 4,846,242 | A | * | 7/1989 | Baier | 160/32 |
| 5,035,091 | A | * | 7/1991 | Ebato | 52/1 |
| 5,048,588 | A | * | 9/1991 | Weishar et al. | 160/265 |
| 5,088,543 | A | * | 2/1992 | Bilbrey | 160/310 |
| 5,129,442 | A | * | 7/1992 | Warner | 160/271 |
| 5,159,967 | A | * | 11/1992 | Ashley et al. | 160/265 |
| 5,287,908 | A | | 2/1994 | Hoffmann et al. | |
| 5,299,617 | A | * | 4/1994 | Hying et al. | 160/271 |
| 5,467,266 | A | | 11/1995 | Jacobs et al. | |
| 5,535,806 | A | * | 7/1996 | Kold et al. | 160/273.1 |
| 5,671,387 | A | | 9/1997 | Jacobs et al. | |
| 5,752,557 | A | * | 5/1998 | Crider et al. | 160/121.1 |
| 5,848,634 | A | | 12/1998 | Will et al. | |
| 5,889,377 | A | | 3/1999 | Mao | |
| 6,144,177 | A | | 11/2000 | Mao | |
| 6,206,076 | B1 | * | 3/2001 | Stawski | 160/98 |
| 6,439,292 | B1 | * | 8/2002 | Schutte et al. | 160/265 |
| 6,796,356 | B2 | | 9/2004 | Kirby | |
| 6,796,357 | B2 | | 9/2004 | Kirby | |
| 6,983,783 | B2 | | 1/2006 | Carmen, Jr. et al. | |
| 7,059,376 | B2 | | 6/2006 | Tussinger | |
| 7,311,133 | B2 | | 12/2007 | Anderson et al. | |
| 2005/0247412 | A1 | * | 11/2005 | Bengtsson et al. | 160/265 |
| 2009/0229770 | A1 | | 9/2009 | Kirby | |

FOREIGN PATENT DOCUMENTS

| | | | |
|---|---|---|---|
| DE | 3806621 | A1 | 10/1989 |
| DE | 4036892 | A1 | 5/1992 |
| DE | 19545735 | C1 | 1/1997 |
| EP | 0208103 | A1 | 1/1987 |
| EP | 1319772 | A1 | 6/2003 |

OTHER PUBLICATIONS

Nysan Solar Control Systems, Skylight Shading Brochure, 2007, 16 pages.

Nysan Solar Control Systems, Interior Roller Shades Brochure, 2007, 28 pages.

U.S. Appl. No. 12/238,922, filed Sep. 26, 2008, Kirby et al.

* cited by examiner

SELF-CONTAINED TENSIONED ROLLER SHADE SYSTEM

RELATED APPLICATIONS

This application claims priority from commonly-assigned U.S. Provisional Application Ser. No. 61/035,911, filed Mar. 12, 2008, having the same title as the present application, the entire disclosure of which is hereby incorporated by reference.

BACKGROUND OF THE INVENTION

1. Field of the Invention

The present invention relates to a motorized window treatment, and more particularly, to a self-contained tensioned roller shade system that allows for easy installation into a window opening oriented, for example, in a non-vertical plane, such as a skylight.

2. Description of the Related Art

Typical motorized window treatments, such as, for example, roller shades, draperies, roman shades, and venetian blinds, are mounted in front of vertically-oriented windows to prevent sunlight from entering a space and to provide privacy. A motorized roller shade includes a flexible shade fabric wound onto an elongated roller tube. The flexible shade fabric typically includes a weighted hembar at a lower end of the shade fabric, such that the shade fabric is pulled down by gravity and simply hangs in front of the window. Motorized roller shades include a drive system engaging the roller tube to provide for tube rotation, such that the lower end of the shade fabric can be raised and lowered by rotating the roller tube.

While most windows are oriented vertically, skylight windows are typically mounted in a non-vertical plane. Some prior art motorized roller shade systems have been installed in skylight windows. These prior art skylight shade systems typically comprise tensioning systems, in which an amount of tension is provided to the shade fabric to minimize the sagging in the shade fabric. One prior art tensioning system includes two roller tubes where each roller tube is rotated by a separate motor. Specifically, one of the roller tubes is coupled to a first end of the shade fabric and windingly receives the shade fabric. The second roller tube winds up cables that are attached to a second end of the shade fabric, such that the shade fabric may be pulled by the cables as the second roller tube rotates. Since the motor in each of the roller tubes is stressed by the tension of the shade fabric, the motors must be larger (and thus noisier) than typical motors. Further, separately controlling each of the motors of this "dual-motor" shade system (e.g., to pull the shade fabric, to stop movement of the shade fabric, to apply the appropriate tension to the shade fabric) is rather complex and unreliable.

Another prior art tensioning system also includes two roller tubes with a first roller tube rotated by a motor (at a first end of the shade fabric) and a second roller tube that is spring-biased to provide tension in the shade fabric. Once again, the motor is stressed by the tension of the shade fabric and thus is larger and noisier than a typical motor. Further, the spring of the spring-biased roller tube limits the size (i.e., the length) of the shade fabric that may be tensioned by the roller shade system. An example of such a tensioning system is described in greater detail in U.S. Pat. No. 5,467,266, issued Nov. 14, 1995, entitled MOTOR-OPERATED WINDOW COVER. Both of these prior art tensioning systems require all of the system components to be individually installed in the opening, which can be rather difficult for a skylight window.

There is a need for a skylight shade system that minimizes the stress on the motor due to the tension in the shade fabric. Further, there is also a need for a skylight shade system that is easy to install and is scalable to allow for multiple sizes of roller tubes and shade fabrics.

SUMMARY OF THE INVENTION

According to an embodiment of the present invention, a self-contained tensioned roller shade system is adapted to be mounted in an opening having first and second opposite sides, and third and fourth opposite sides, and comprises a free-standing frame, a roller tube, a shade fabric, a first pulley, and a first tensioning cord. The frame has first and second side spaced-apart parallel channels adapted to be mounted along the first and second opposite sides of the opening, respectively (each of the side channels having a proximal end and a distal end), and a first frame end coupled between the proximal ends of the side channels and adapted to be mounted along the third side of the opening. The roller tube is rotatably mounted between the proximal ends of the first and second side channels adjacent the first frame end. The shade fabric has a first fabric end connected to the roller tube (such that the shade fabric is windingly received around the roller tube) and a second fabric end opposite the first fabric end. The first pulley is located in the first side channel and is operatively coupled to the frame adjacent the distal end of the first side channel. The first tensioning cord is operatively coupled between the roller tube and the second fabric end, and is coupled to the roller tube for winding receipt about the roller tube. The tensioning cord is windingly received around the first pulley, such that the tensioning cord is adapted to bias the second fabric end toward the distal ends of the side channels, the shade fabric and the tensioning cord apply forces on the frame, and the second fabric end of the shade fabric is adapted to move between the distal ends and the proximal ends of the side channels as the roller tube is rotated. The free-standing frame contains the forces applied by the shade fabric and the tensioning cord to minimize the forces applied by the frame on the opening in which the roller shade system is mounted.

According to another embodiment of the present invention, a self-contained tensioned roller shade system comprises a free-standing frame, a roller tube, a shade fabric, a hembar, first and second pulleys, first and second tensioning cord portions, and a first spring. The frame has first and second opposite sides defining respective first and second side channels, and third and fourth opposite sides defining respective first and second frame ends. The roller tube is rotatably mounted between the first and second side channels of the frame adjacent the first frame end. The shade fabric has a first fabric end connected to the roller tube, such that the shade fabric is windingly received around the roller tube. The hembar is connected to the shade fabric at a second fabric end opposite the first fabric end of the shade fabric. The hembar has a first hembar end received by a first hembar slot of the first side channel and a second hembar end received by a second hembar slot of the second side channel. The first and second hembar slots are formed between a respective flange and a respective interior wall of each side channel, and each define a sidewall beween the respective flange and the respective interior wall. The first and second hembar ends have respective first and second hembar wheels received within the respective first and second hembar slots. Each sidewall has a non-planar surface to allow for rolling contact with the sides of the respective wheels of the hembar. The first and second pulleys are operatively coupled to the frame adjacent the second frame end and are located in the first and second side channels, respectively. The first tensioning cord portion operatively coupled between the first tube end of the roller tube and the first hembar end of the hembar, and is coupled to the roller tube for winding receipt about the first tube end of the roller tube. The second tensioning cord portion is operatively coupled between the second tube end of the roller tube and the second hembar end of the hembar, and is coupled to the roller tube for winding receipt about the second tube end of the roller tube. The first and second tensioning cord portions are windingly received around the first and second pulleys, respectively. The first spring is coupled to the frame, is located within the first side channel, and is operatively coupled to the first tensioning cord portion, such that the hembar is biased towards the second frame end, and is adapted to move between the first and second frame ends as the roller tube is rotated.

According to another embodiment of the present invention, the first and second tensioning cord portions are part of a single tensioning cord that extends through the hembar. The single tensioning cord comprises a first cord end coupled to the roller tube at the first tube end for winding receipt about the roller tube at the first tube end, and a second cord end coupled to the roller tube at the second tube end for winding receipt about the roller tube at the second tube end. The roller shade system further comprises first, second, third, and fourth pulleys connected to the frame adjacent the second frame end, where the first and second pulleys are located within the first side channel and the third and fourth pulleys are located within the second side channel. The tensioning cord is windingly received around the first, second, third, and fourth pulleys. The roller shade system also comprises first and second springs operatively coupled to the frame and located within the first and second side channels, respectively. The roller shade system further comprises fifth and sixth pulleys coupled to the respective first and second springs, and located within the respective first and second side channels. The fifth pulley windingly receives a portion of the tensioning cord between the portions of the tensioning cord received by the first and second pulleys, while the sixth pulley windingly receives a portion of the tensioning cord between the portions of the tensioning cord received by the third and fourth pulleys.

According to yet another embodiment of the present invention, a roller shade system is adapted to be mounted in an opening having first and second opposite sides, and third and fourth opposite sides. The roller shade system comprises a free-standing frame having first and second side channels adapted to be mounted along the first and second opposite sides of the opening, respectively, and first and second frame ends adapted to be mounted along the third and fourth opposite sides of the opening, respectively. The roller shade system also comprises a roller tube adapted to be windingly mounted between the first and second side channels adjacent the third side of the opening, and a shade fabric having a first fabric end connected to the roller tube, such that the shade fabric is windingly received around the roller tube. A tensioning cord is operatively coupled between the roller tube and a second fabric end, and is coupled to the roller tube for winding receipt about the roller tube. The roller shade system further comprises a pulley and a spring located within the first side channel. The pulley is adapted to be operatively coupled to the frame adjacent the fourth side of the opening and windingly receives the tensioning cord. The spring is coupled to the frame and is operatively coupled to the tensioning cord, such that the second fabric end is biased towards the fourth side of the opening, the shade fabric and the tensioning cord apply forces on the first and second frame ends to pull the frame ends towards each other, and the second fabric end of the shade fabric is adapted to move between the third and fourth sides of the opening as the roller tube is rotated. The free-standing frame contains the forces applied on the first and second frame ends by the shade fabric and the tensioning cord to minimize the forces applied by the frame on the opening in which the roller shade system is mounted.

Additionally, a method of installing a self-contained tensioned roller shade system in an opening comprises the steps of: (1) providing a free-standing frame having first and second opposite sides defining respective first and second side channels, and third and fourth opposite sides defining respective first and second frame ends; (2) mounting a roller tube between the first and second side channels of the frame adjacent the first frame end, such that the roller tube is operable to rotate; (3) connecting a first fabric end of a shade fabric to the roller tube, such that the shade fabric is windingly received around the roller tube; (4) coupling a tensioning cord to the roller tube for winding receipt about the roller tube; (5) coupling the tensioning cord to a pulley operatively coupled to the frame adjacent the second frame end, such that the tensioning cord is windingly received around the pulley; (6) operatively coupling the tensioning cord to a second fabric end opposite the first fabric end of the shade fabric; (7) connecting a spring between the pulley and the frame; (8) biasing the second fabric end towards the second frame end; (9) adjusting the amount of force applied to the tensioning cord by the spring; and (10) subsequently installing the frame into the opening, such that the free-standing frame contains the forces applied by the shade fabric and the tensioning cord to minimize the forces applied by the frame on the opening in which the roller shade system is mounted, and the second fabric end of the shade fabric is adapted to move between the first and second frame ends as the roller tube is rotated.

Other features and advantages of the present invention will become apparent from the following description of the invention that refers to the accompanying drawings.

DETAILED DESCRIPTION OF THE INVENTION

Figure 1:
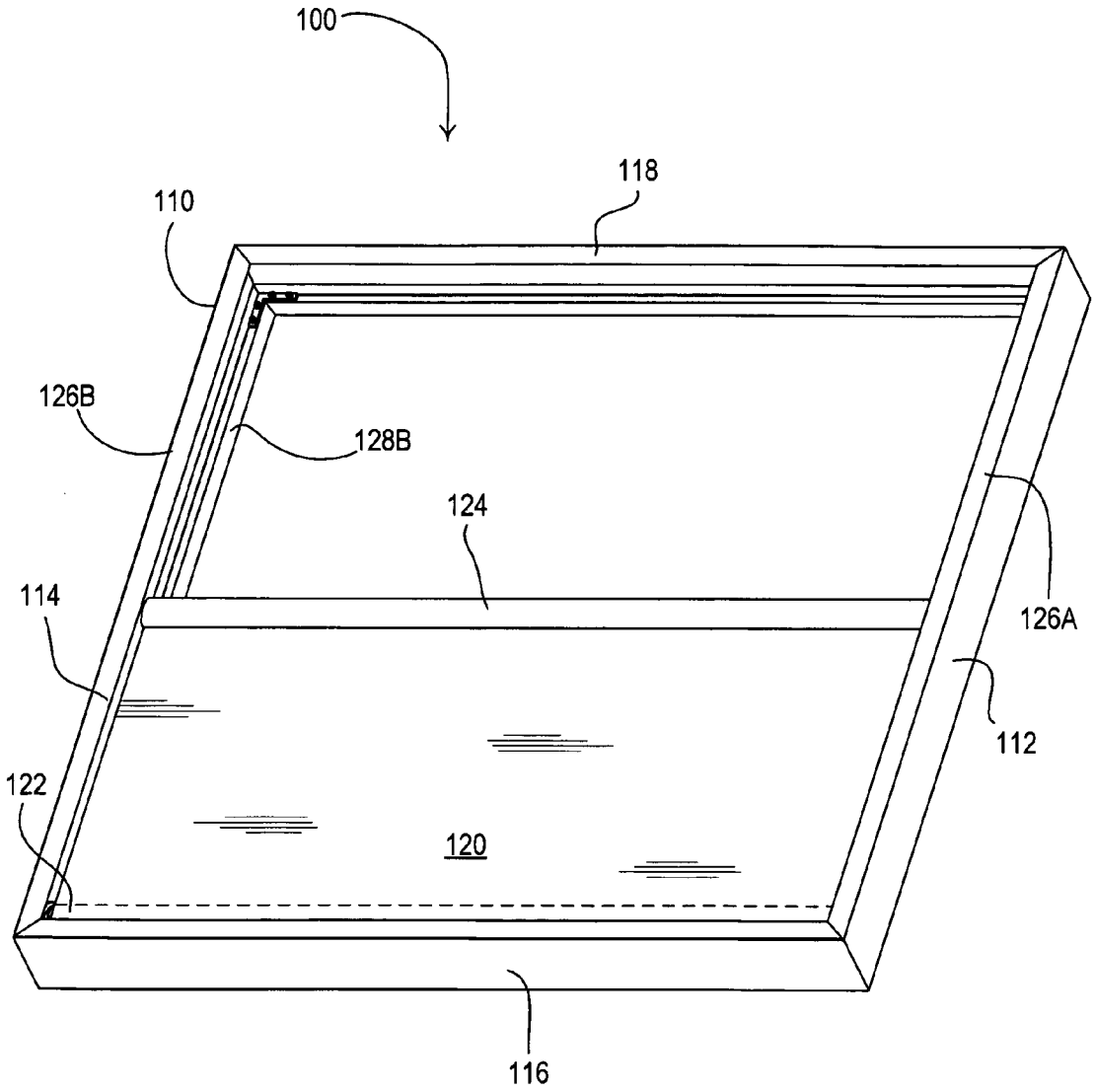
FIG. 1 is a perspective view a self-contained tensioned roller shade system for mounting in an opening, such as a window or a skylight, according to a first embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2:
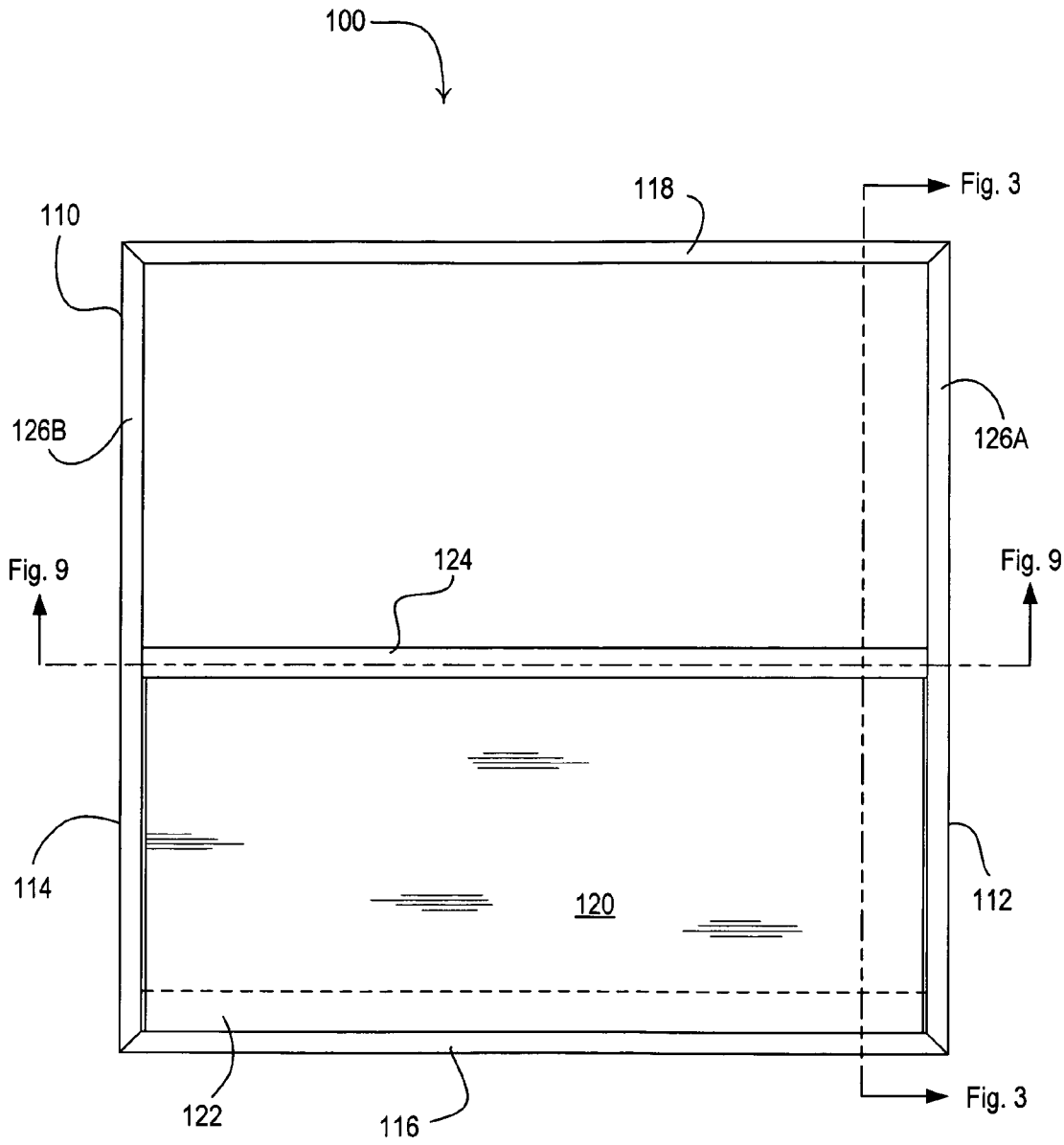
FIG. 2 is a front view of the roller shade system of FIG. 1.

FIG. 1 is a perspective view and FIG. 2 is a front view of a self-contained tensioned roller shade system 100 adapted to be easily mounted in an opening (such as, a window) that is oriented in a vertical plane or in a non-vertical plane (such as, a skylight that may be mounted, for example, horizontally). Note that if the roller shade system 100 is mounted in a skylight, the perspective view of FIG. 1 and the front view of FIG. 2, would be viewed from the outside of the skylight window.

The roller shade system 100 comprises a free-standing frame 110, which allows the roller shade system 100 to be assembled in the frame before the roller shade system is installed in the opening, therefore providing for an easy installation process. The frame 110 has first and second spaced-apart, opposite sides defining respective first and second side channels 112, 114, and third and fourth spaced-apart, opposite sides defining respective first and second frame ends 116, 118. The first and second side channels 112, 114 each have proximal ends (adjacent the first frame end 116) and distal ends (adjacent the second frame end 118). The roller shade system 100 further comprises a shade fabric 120 coupled between a roller tube 122 and a hembar 124. The roller tube 122 is rotatably mounted between the proximal ends of the first and second side channels 112, 114 adjacent the first frame end 116 and is located below the shade fabric 120 (as shown in FIGS. 1 and 2).

A first fabric end of the shade fabric 120 is connected to the roller tube 122, such that the shade fabric is windingly received around the roller tube. The hembar 124 is connected to a second fabric end of the shade fabric 120 and has first and second hembar ends that are coupled to respective hembar slots 152A, 152B (FIG. 3) in the respective side channels 112, 114. The roller shade system 100 comprises a tensioning system (as will be described in greater detail below), which is used to translate the hembar 124 along the hembar slots 152A, 152B between the first frame end 116 and the second frame end 118 as the roller tube 122 is rotated.

The first side channel 112 comprises a first flange 126A and a second flange 128A (FIG. 6), while the second side channel 114 comprises a first flange 126B and a second flange 128B. The flanges 126A, 126B, 128A, 128B provide additional structure for the frame 110, while also hiding the operational components of the tensioning system of the roller shade system 100 from view. The first and second flanges 126A, 126B, 128A, 128B of each side channel 112, 114 are spaced apart appropriately, such that the roller tube 122 may be easily unmounted and removed from the frame 110. For example, the first and second flanges 126A, 126B, 128A, 128B may be spaced apart at a distance greater than the diameter of the roller tube 122.

Figure 3:
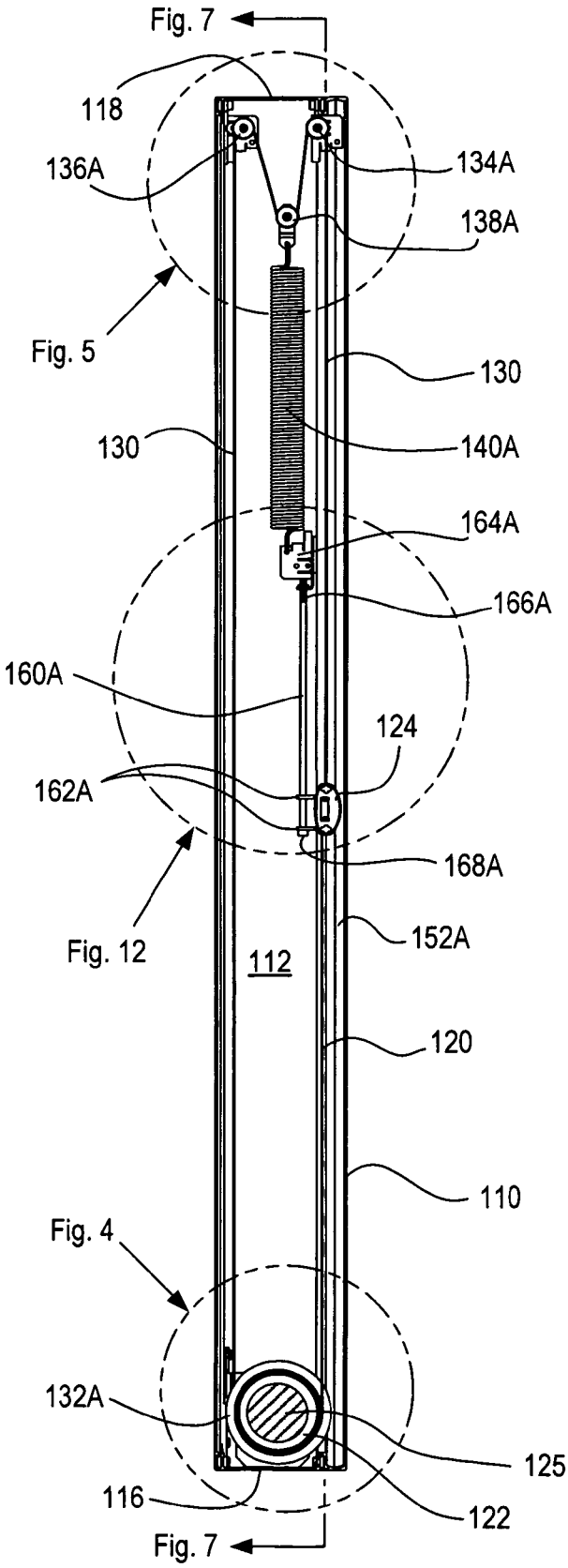
FIG. 3 is a left-side cross-sectional view of the roller shade system of FIG. 1.

FIG. 3 is a left-side cross-sectional view of the roller shade system 100 taken across the sectional line shown in FIG. 2 showing the first side channel 112. A drive system, such as, for example, a motor drive unit 125, may be coupled to the roller tube 120 to allow for control of the rotation of the roller tube by a user of the roller shade system 100. The motor drive unit 125 may be physically located inside the roller tube 122 (as shown in FIG. 3) or may be mounted externally to the roller tube. An example of the motor drive unit 125 is described in greater detail in U.S. Pat. No. 6,983,783, issued Jan. 10, 2006, entitled MOTORIZED SHADE CONTROL SYSTEM, the entire disclosure of which is hereby incorporated by reference.

Figure 3A:
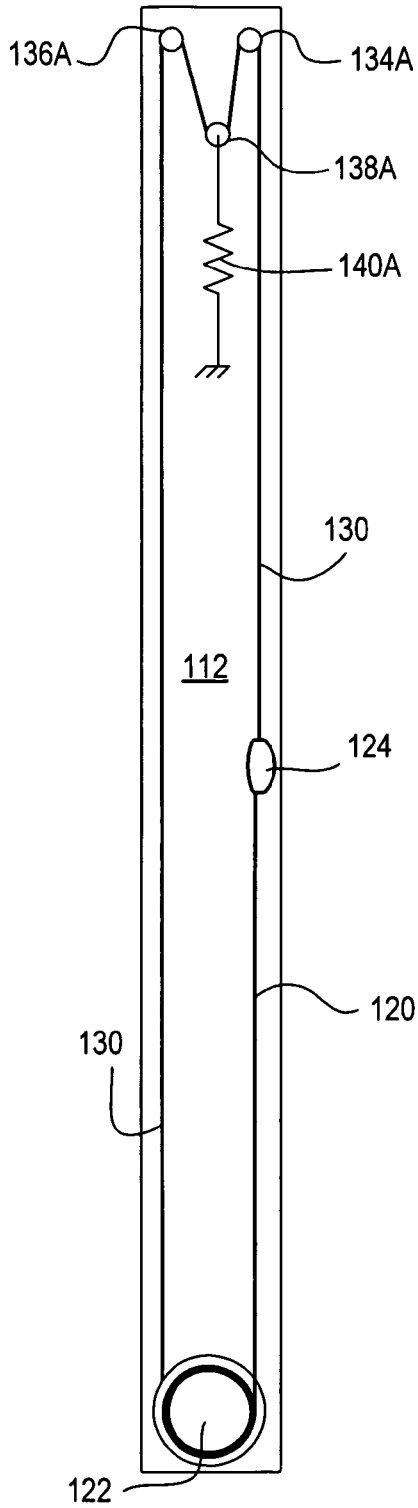
FIG. 3*a* is a simplified left-side schematic view of the roller shade system of FIG. 1.
Figure 4:
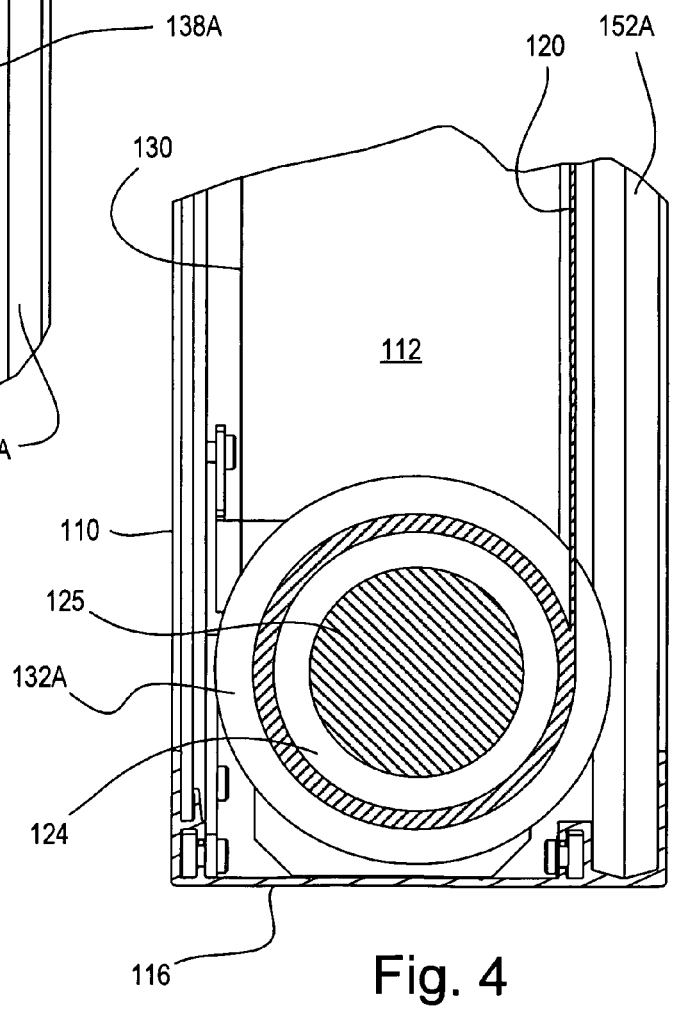
FIG. 4 is an enlarged detail of the left-side cross-sectional view of FIG. 3 showing an end of a roller tube of the roller shade system in greater detail.

The roller shade system 100 includes a tensioning cord 130, which may comprise a stainless steel cable, a liquid crystal polymer cable (such as Vectran™ cable manufactured by Cortland Cable, Inc.), or any suitable cord, cable, rope, or line. The tensioning cord 130 is operatively coupled between the roller tube 122 and the hembar 124 at the second fabric end of the shade fabric 120. FIG. 3*a* is a simplified left-side schematic view of the roller shade system 100 showing the cord 130 operatively coupled between the roller tube 122 and the hembar 124. The tensioning cord 130 is windingly received around a cord-receiving portion 132A at a first tube end of the roller tube 122 as shown in FIG. 3. FIG. 4 is an enlarged detail of the left-side cross-sectional view of the roller shade system 100 of FIG. 3 showing the first end of the roller tube 122 in greater detail.

Figure 5:
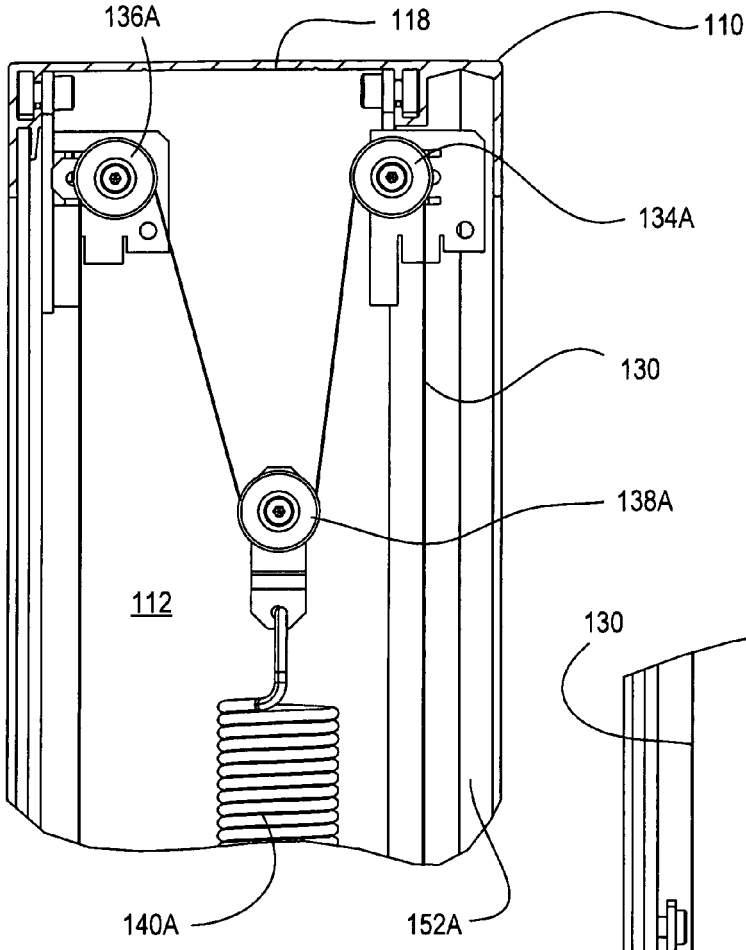
FIG. 5 is an enlarged detail of the left-side cross-sectional view of FIG. 3 showing pulleys of the roller shade system in greater detail.
Figure 6:
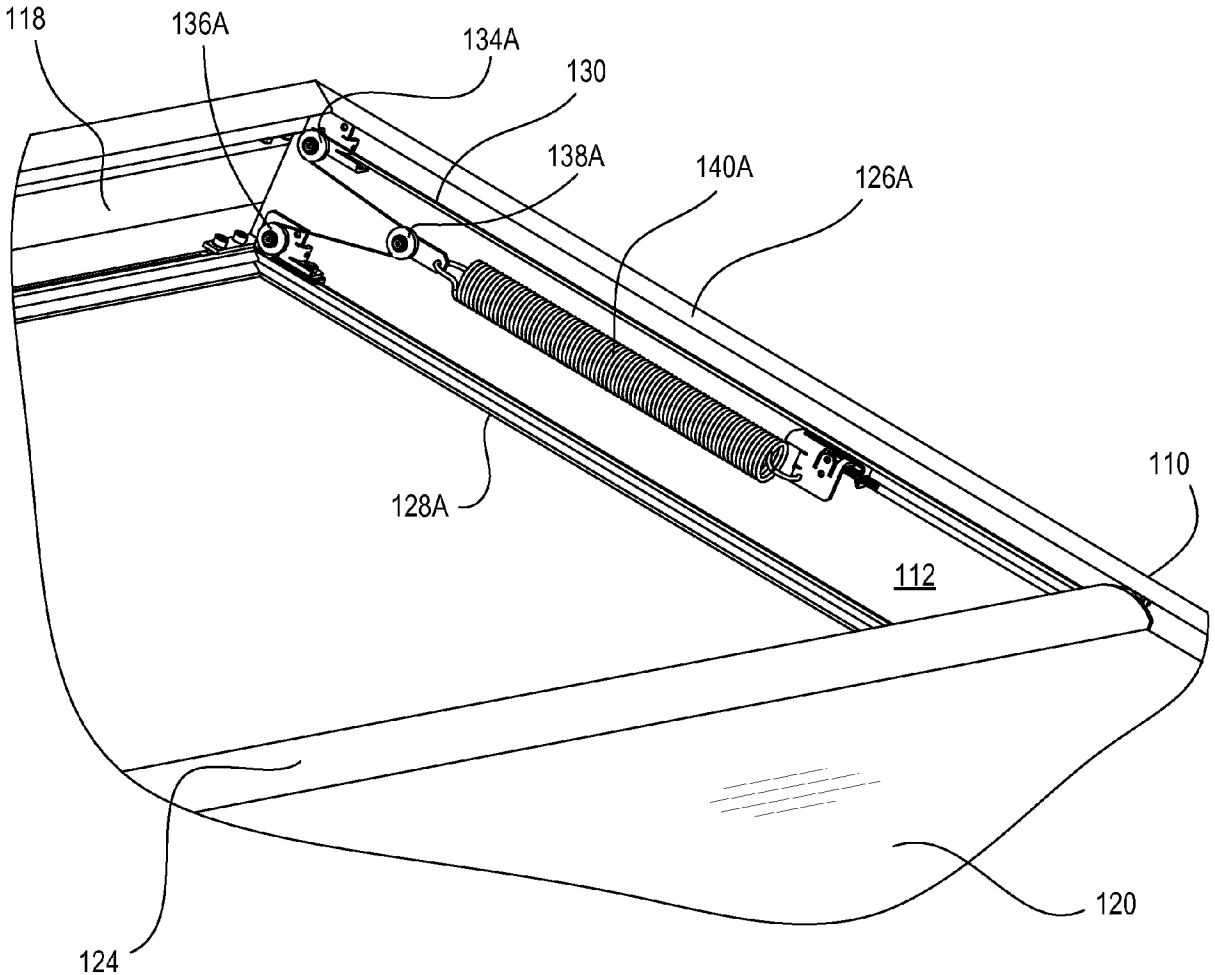
FIG. 6 is a partial perspective view of the roller shade system showing the pulleys of FIG. 5 in greater detail.

The tensioning cord 130 is coupled to a pulley system comprising a first pulley 134A, a second pulley 136B, and a third pulley 138A, which are located adjacent the second frame end 118. Specifically, the tensioning cord 130 is windingly received by the first, second, and third pulleys 134A, 136A, 138A, such that the third pulley 138A windingly receives a portion of the tensioning cord between the portions of the tensioning cord presently received by the first and second pulleys 134A, 136A. FIG. 5 is an enlarged detail of the left-side cross-sectional view (of FIG. 3) and FIG. 6 is a partial perspective view of the roller shade system 100 showing the first, second, and third pulleys 134A, 136A, 138A in greater detail. The first and second pulleys 134A, 136A are directly coupled to the first side channel 112 of the frame 110. However, the third pulley 138A is operatively coupled to the first side channel 112 of the frame 110 via a spring 140A, such that the tensioning cord 130 is spring-biased to pull the hembar 124 towards the second frame end 118. Accordingly, the shade fabric 120 is held taut between the roller tube 122 and the hembar 124, such that there is minimal sagging of the shade fabric when the roller shade system 100 is mounted in a non-vertical plane. The first, second, and third pulleys 134A, 136A, 138A and the spring 140A are hid from the view of the user by the first and second flanges 126A, 128B of the first side channel 112.

The first side channel 112 is sized such that there is an abundance of space for the spring 140A to occupy. Accordingly, the spring 140A may be then sized appropriately large to accommodate for different thicknesses and surface areas of the shade fabric 120 received around the roller tube 122. Therefore, the roller shade system 100 is easily scaled to thus mount roller shades having different shade fabric thicknesses, weights, and sizes (i.e., surface areas).

When the motor drive unit 125 rotates the roller tube 122, the hembar 124 is operable to translate between the first frame end 116 and the second frame end 118. Specifically, as the roller tube 122 rotates to wind up the tensioning cord 130, the hembar 124 is pulled by the tensioning cord and moves towards the second frame end 118 of the frame 110. When the roller tube 122 is rotated such that the shade fabric 120 is wound up, the hembar 124 is pulled towards the first frame end 116.

Figure 7:
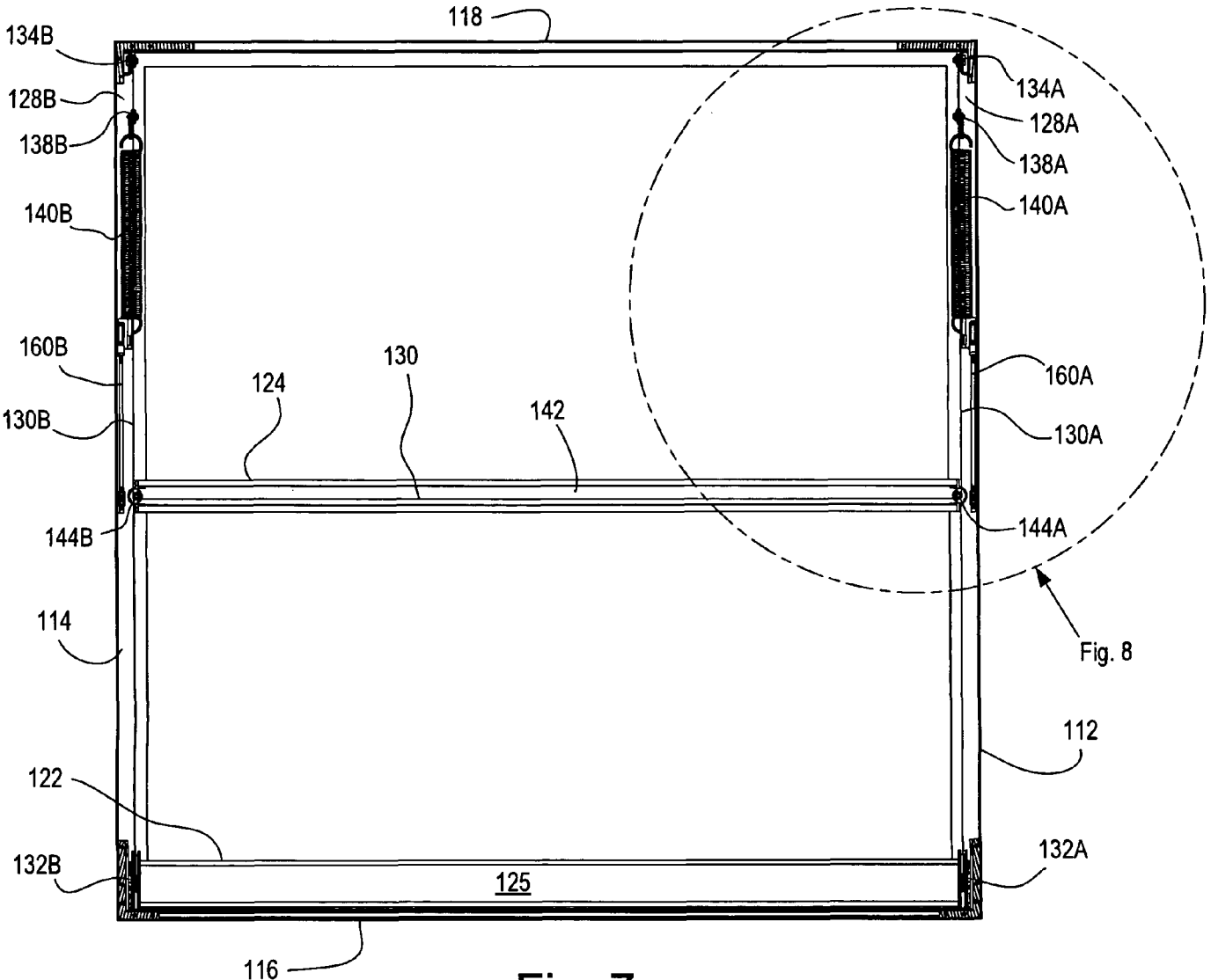
FIG. 7 is a front cross-sectional view of the roller shade system of FIG. 1.

FIG. 7 is a front cross-sectional view of the roller shade system 100 taken across the sectional line shown in FIG. 3 showing both the first and second side channels 112, 114. In the second side channel 114, the roller shade system 100 also include a second pulley system (including first, second, and third pulleys 134B, 136B, 138B) and a second spring 140B, which operate in the same fashion as the first, second, and third pulleys 134A, 136A, 138B and the spring 140A of the first side channel 112 as described above. The pulley systems in each of the side channels 112, 114 provide for equal forces to be applied to the hembar 124, thus allowing the hembar to remain parallel with the first and second frame ends 116, 118 as the hembar translates across the frame 110. The pulley systems and the springs 140A, 140B also operate to reduce the stress applied to the motor drive unit 125 in the roller tube 122.

The roller tube 122 includes a second cord-receiving portion 132B at a second tube end that is rotatably coupled to the second side channel 114. The tensioning cord 130 comprises a single cord that extends from the cord-receiving portions 132A, 132B of the roller tube 122 through a hembar channel 142 of the hembar 124 and through each of the pulley systems of the first and second side channels 112, 114. The springs 140A, 14B may be equal in size, such that the forces applied to the hembar 124 by the tensioning cord on each side of the roller shade system 100 are approximately the same. Alternatively, the roller shade system 100 could comprise a single larger spring in one of the side channels 112, 114. Since the tensioning cord 130 extends through the hembar 124 through both side channels 112, 114, the single larger spring can be sized to appropriately tension the hembar 124 on both sides of the roller shade system 100.

The tensioning cord 130 comprises a first cord end windingly received by the first cord-receiving portion 132A and a second cord end windingly received by the second cord-receiving portion 132B, such that the first and second cord ends are windingly received about the roller tube 122. The tensioning cord 130 comprises a first tensioning cord portion 130A in the first side channel 112 (from the first hembar end of the hembar 124 to the first cord-receiving portion 132A) and a second tensioning cord portion 130B in the second side channel 114 (from the second hembar end of the hembar 124 to the second cord-receiving portion 132B). Alternatively, the first and second tensioning cord portions 130A, 130B could be two separate tensioning cords having ends fixedly attached to the respective first and second hembar ends of the hembar 124. If two separate tensioning cords are provided (i.e., first and second tensioning cord portions 130A, 130B), a single spring may not be provided in one of the first and second side channels 112, 114, i.e., springs 140A, 140B are provided in each of the first and second side channels, respectively.

When the roller shade system 100 is installed in the opening, the structure of the frame 110 minimizes the stresses applied to the building structure from the tension in the roller shade system 100. The tension in the shade fabric 120 and the tensioning cord 130 applies forces on the first and second frame ends 116, 118 to pull the frame ends towards each other. Since the side channels 112, 114 are connected between the first and second frame ends 116, 118, the forces of the roller shade system 110 are contained in the frame 110, thus minimizing the forces applied by the roller shade system to the building structure.

Figure 8:
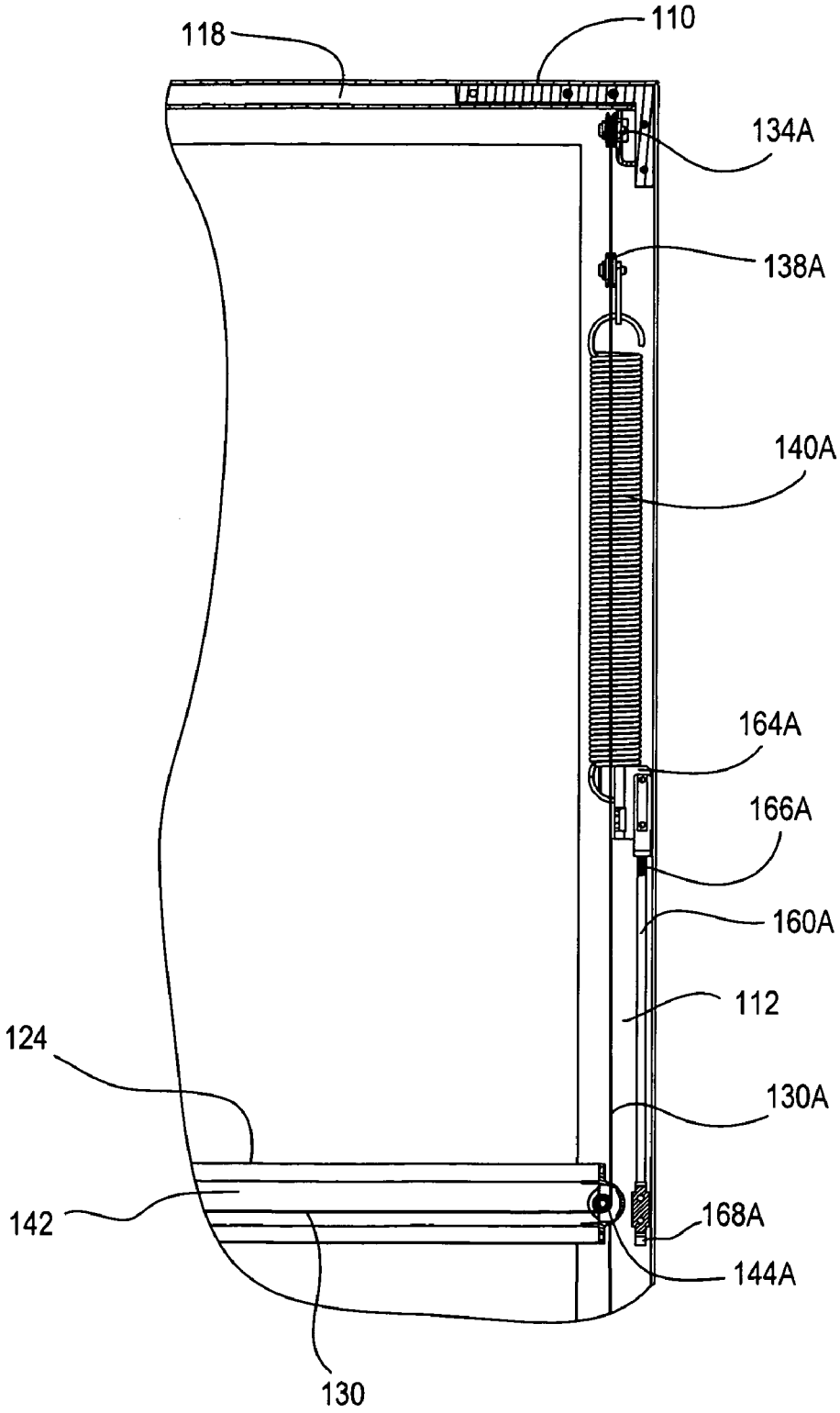
FIG. 8 is an enlarged detail of the front cross-sectional view of FIG. 7 showing a first side channel and a first hembar end of a hembar of the roller shade system in greater detail.
Figure 9:
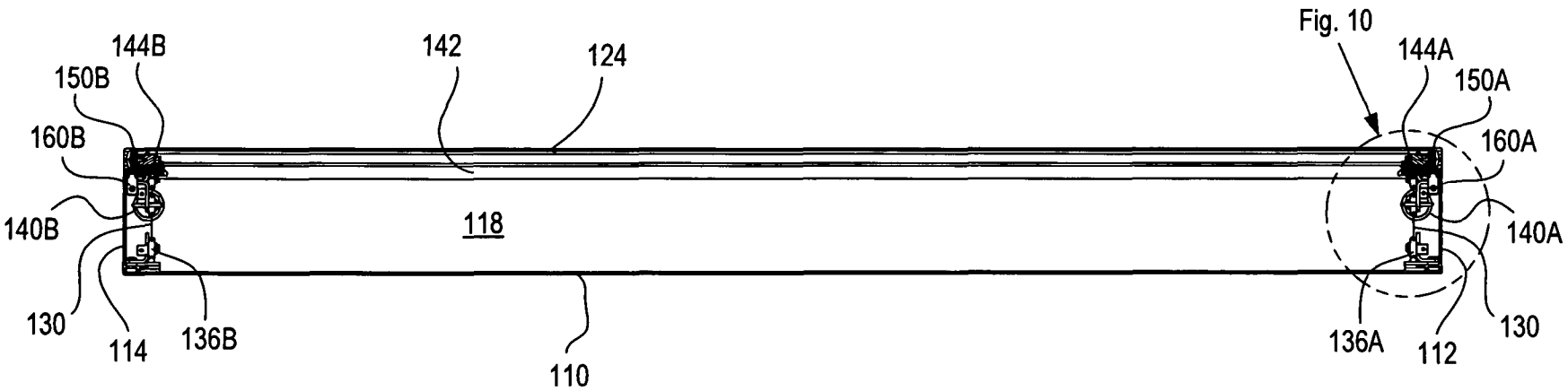
FIG. 9 is a bottom cross-sectional view of the roller shade system of FIG. 1.
Figure 10:
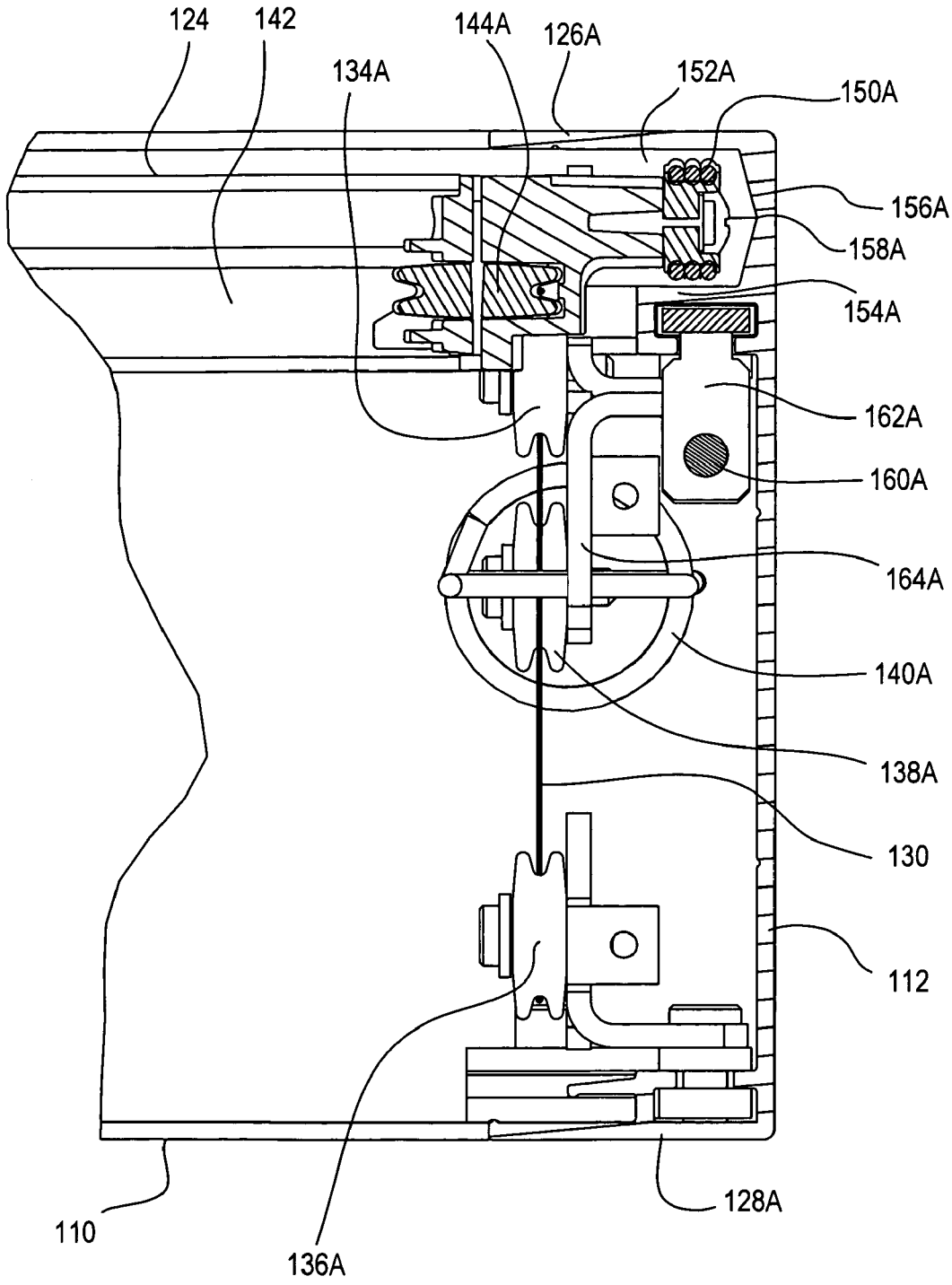
FIG. 10 is an enlarged detail of the bottom cross-sectional view of FIG. 9 showing the first side channel in greater detail.
Figure 11:
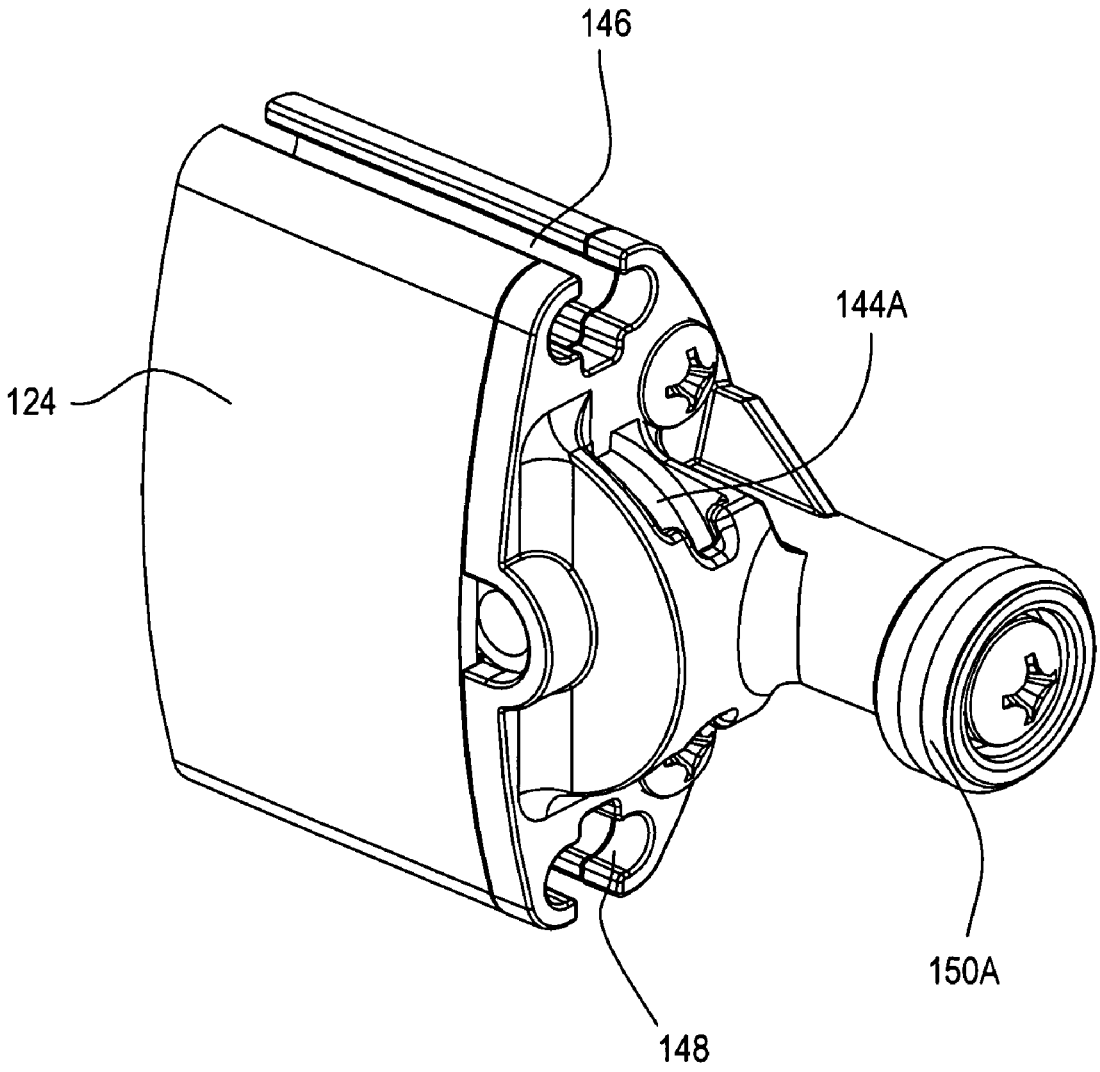
FIG. 11 is a perspective view of the first hembar end of the hembar of the roller shade system of FIG. 1.

FIG. 8 is an enlarged detail of the front cross-sectional view of FIG. 7 showing the first side channel 112 and the first hembar end of the hembar 124 in greater detail. FIG. 9 is a bottom cross-sectional view of the roller shade system 100 taken across the sectional line shown in FIG. 2. FIG. 10 is an enlarged detail of the bottom cross-sectional view of the roller shade system 100 of in FIG. 9 showing the first side channel 112 in greater detail. FIG. 11 is a perspective view of the first hembar end of the hembar 124 without the shade fabric 120 and the tensioning cord 130 shown. Note the second hembar end of the hembar 124 is identical to the first hembar end shown in FIG. 11.

The first hembar end of the hembar 124 includes a first hembar pulley 144A. The tensioning cord 130 extends from the first pulley 134A and is windingly received by the first hembar pulley 144A. The tensioning cord 130 extends from the first hembar pulley 144A through the hembar channel 142 of the hembar 124 to a second hembar pulley 144B at the second hembar end. As the hembar 124 is transitioning across the frame 110, the hembar remains parallel with the first and second frame ends 116, 118 even if the tensioning cord winds differently in each of the first and second cord-receiving portions 132A, 132B of the roller tube 122. For example, the tensioning cord 130 may wind up neatly in the first cord-receiving 132A, but may wind up in an over-lapping fashion in the second cord-receiving portion 132B, thus shortening the effective length of the tensioning cord. However, since the tensioning cord 130 extends through the hembar channel 142 of the hembar 124 and is enabled (by the hembar pulleys 144A, 144B) to move through the hembar, the portion of the tensioning cord extending from the hembar 124 to the roller tube 122 in each of the side channels 112, 114 remains approximately the same, thus allowing the hembar to remain parallel with the first and second frame ends 116, 118.

The hembar 124 also includes fabric-receiving slots 146, 148 in which the shade fabric 120 may be fastened to the hembar (FIG. 11). The method of attaching the shade fabric 120 to the fabric-receiving slots 146, 148 of the hembar 124 is described in greater detail in U.S. patent application Ser. No. 11/890,186, filed Aug. 3, 2007, entitled HEMBAR FOR A SHADE FABRIC AND ASSEMBLY METHOD, the entire disclosure of which is hereby incorporated by reference.

The first and second hembar ends of the hembar 124 include respective first and second hembar wheels 150A, 150B. The first and second hembar wheels 150A, 150B are received within the hembar slots 152A, 152B of the first and second side channels 112, 114, respectively. Referring to FIG. 10, the first hembar slot 152A is formed between the first flange 126A and an interior wall 154A. A sidewall 156A of the first hembar slot 152A extends from the first flange 126A to the interior wall 154A. The first hembar wheel 150A is adapted to roll along a contact surface defined by the interior wall 154A, such that the hembar 124 is operable to translate across the frame 110. The first sidewall 156A defines a non-linear surface, i.e., includes an indentation 158A, which allows for rolling contact rather than sliding contact between the side of the first hembar wheel 150A and the first sidewall 156A. Note that the second hembar slot 152B of the second side channel 114 has an identical structure to the first hembar slot 152A of the first side channel 112. Specifically, the second hembar slot 152B is formed between the first flange 126B and an interior wall 154B of the second side channel 114 defining a non-linear sidewall 156B having an indentation 158B.

Figure 12:
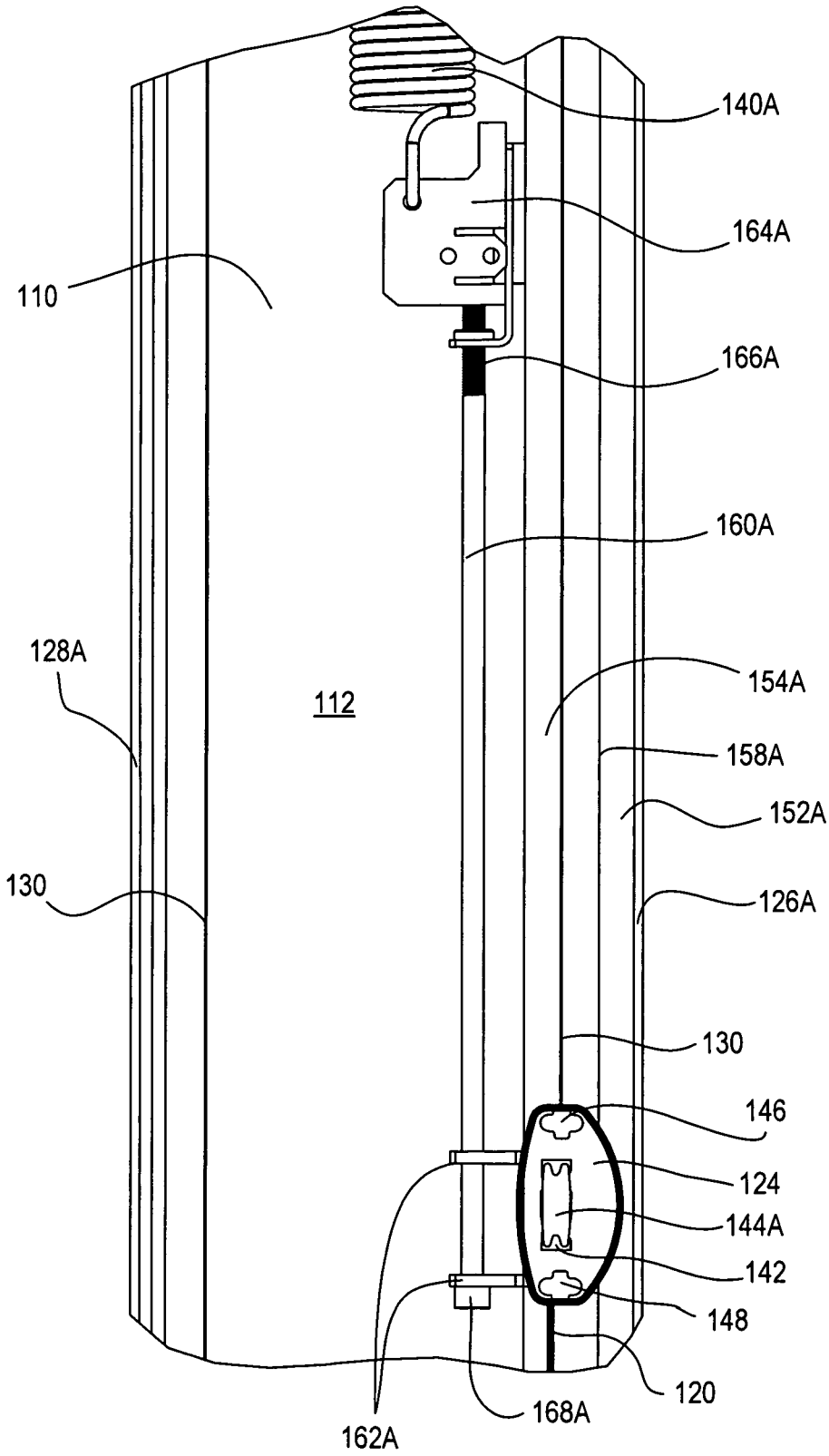
FIG. 12 is an enlarged detail of the left-side cross-sectional view of FIG. 3 showing a tensioning screw of the roller shade system in greater detail.

Tensioning adjustment means, e.g., tensioning screws 160A, 160B, are provided in each of the first and second side channels 112, 114 to allow for adjustment of the amount of force applied by the tensioning cord 130 on the hembar 124. FIG. 12 is an enlarged detail of the left-side cross-sectional view of FIG. 3 showing the tensioning screw 160A of the first side channel 112 in greater detail. The tensioning screw 160A is coupled to the interior wall 154A of the side channel via two mounting legs 162A. The tensioning screw 160A is then coupled to the spring 140A via a coupling plate 164A. The tensioning screw 160A comprises a threaded portion 166A, which is screwed into the coupling plate 164A, such that the tension in the spring 140A may be increased when the tensioning screw 160A is rotated in a first direction and the tension in the spring 140A may be decreased when the tensioning screw is rotated in a second direction. The tensioning screw 160A includes a ratchet head 168A, such that the installer of the roller shade system 100 may easily rotate the tensioning screw (e.g., using a motorized ratchet tool) to adjust the tension in the spring 140A and thus the tensioning cord 130. The tensioning screw 160B in the second side channel 114 has the same structure as the tensioning screw 160A of the first side channel 112 and similarly includes mounting legs 162B, a coupling plate 164B, a threaded portion 166B, and a ratchet head 168B. Accordingly, after the roller shade system 100 is assembled in the frame 110, but before the roller shade system is installed in the opening, the tension in the springs 140A, 140B may be adjusted using the tensioning screws 160A, 160B such that the appropriate amount of force is applied by the tensioning cord 130 onto the hembar 124.

Accordingly, the roller shade system 100 may be easily tensioned and installed in an opening, such as a skylight or other window oriented in a non-vertical plane. Before the roller shade system is installed in the opening, the roller shade system is assembled in the free-standing frame 110. The assembly of the roller shade system may occur at the installation site or at a manufacturing facility, such that the roller shade system is shipped as a "pre-hung" tensioned roller shade system. During the assembly of the roller shade system, the roller tube 122 is mounted between the first and second side channels 112, 114 of the frame 110 adjacent the first frame end 116, and the first fabric end of the shade fabric 120 is coupled to the roller tube 122 and wound around the roller tube. The second fabric end of the shade fabric 120 is coupled to the hembar 124. The tensioning cord 130 is extended through the hembar 124, coupled to the pulleys 134A-138B of the roller shade assembly 100, and wound appropriately around the roller tube 122. The springs 140A, 140B are installed in the side channels 112, 114, such that the hembar is biased towards the second frame end 118. Before the roller shade assembly 100 is installed in the opening, the tensioning screws 160A, 160B are adjusted to modify the amount of force applied to the tensioning cord 130 by the springs 140A, 140B. The frame 110 is then ready to be installed into the opening.

Figure 13:
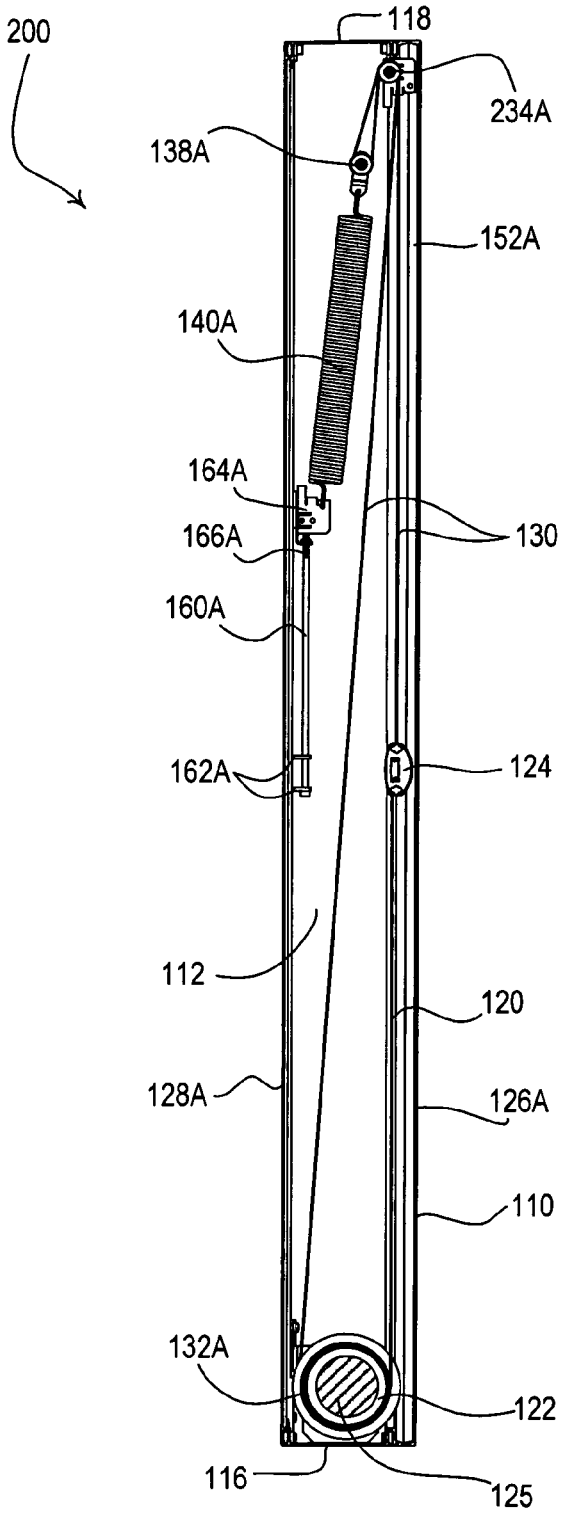
FIG. 13 is a left-side cross-sectional view of a roller shade system according to a second embodiment of the present invention.
Figure 13A:
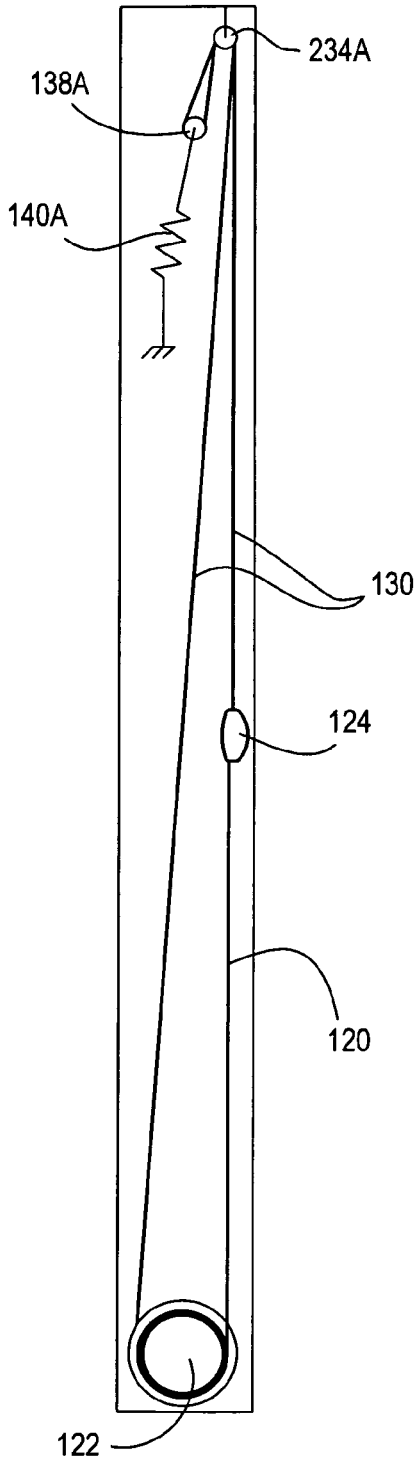
FIG. 13*a* is a simplified left-side schematic view of the roller shade system of FIG. 13.

FIG. 13 is a left-side cross-sectional view of a roller shade system 200 according to a second embodiment of the present invention. Note that the view of FIG. 13 is taken across the same sectional line as FIG. 3 (i.e., as shown in FIG. 2). Rather than including three separate pulleys 134A, 136A, 138A in the first side channel 112, the roller shade system 200 of FIG. 13 includes one single pulley 138A and one dual pulley 234A, which comprises two pulleys located immediately adjacent each other and operable to rotate about the same axis. FIG. 13*a* is a simplified left-side schematic view of the roller shade system 200 showing the interaction between the shade fabric 120, the roller tube 122, the hembar 124, the tensioning cord 130, the pulleys 234A, 138A, and the spring 140A. The tensioning cord 130 is windingly received by the both pulleys of the dual pulley 234A. The third pulley 138A windingly receives a portion of the tensioning cord between the portions of the tensioning cord presently received by both pulleys of the dual pulley 234A. The tensioning screw 160A is attached to the second flange 128A of the first side channel 112.

Figure 14:
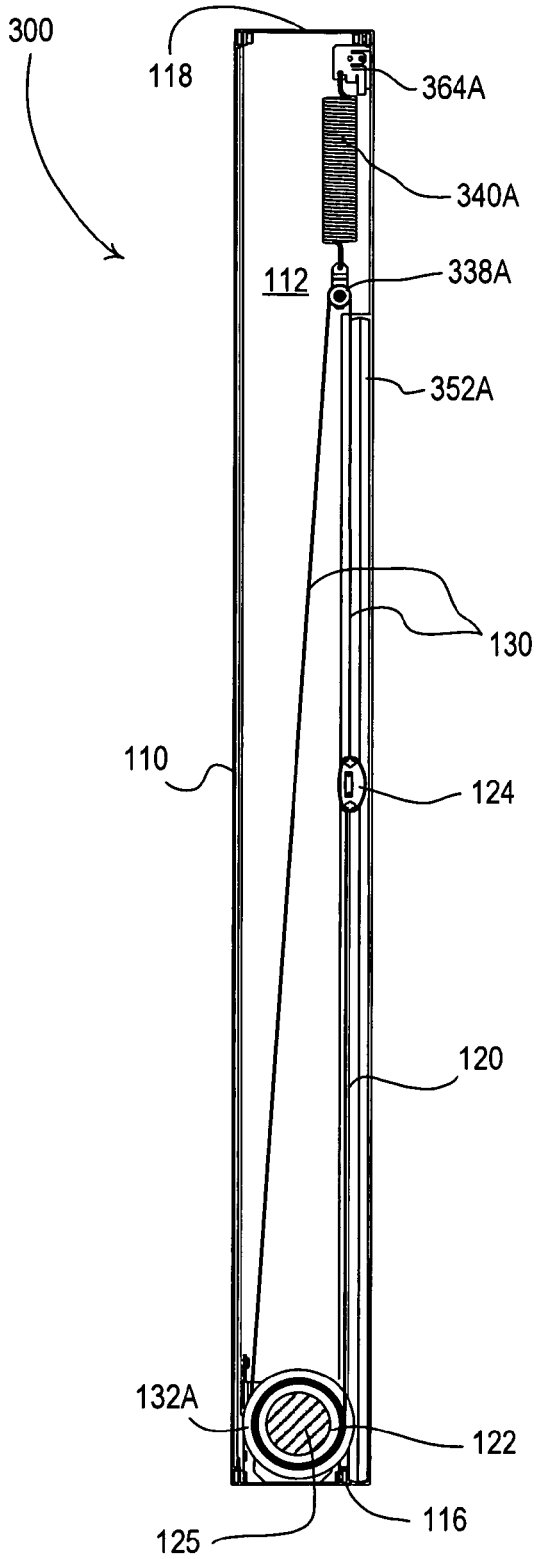
FIG. 14 is a left-side cross-sectional view of a roller shade system according to a third embodiment of the present invention.
Figure 14A:
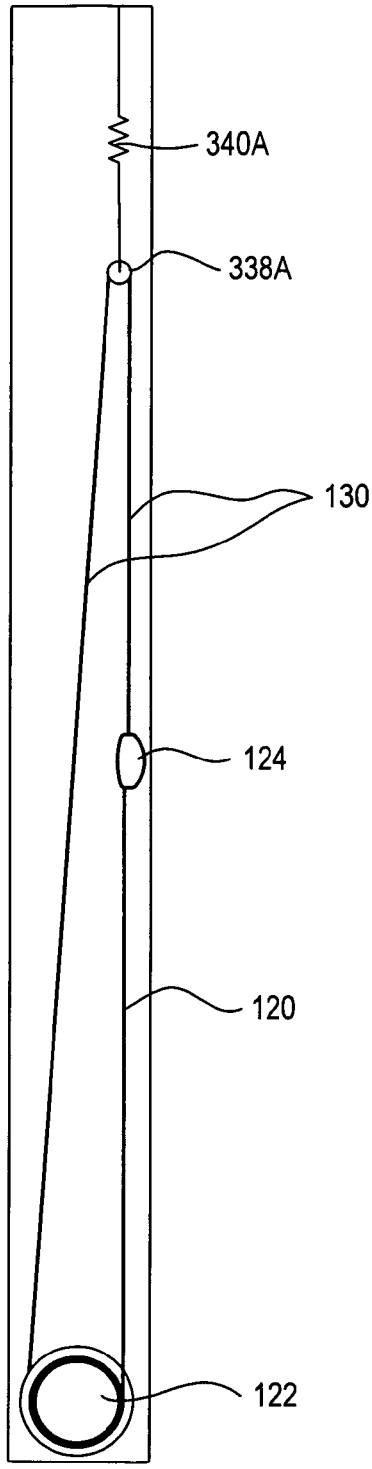
FIG. 14*a* is a simplified left-side schematic view of the roller shade system of FIG. 14.

FIG. 14 is a left-side cross-sectional view of a roller shade system 300 according to a third embodiment of the present invention, which is taken across the same sectional line as FIG. 3 (i.e., as shown in FIG. 2). The roller shade system 300 of FIG. 14 includes one single pulley 338A that windingly receives the tensioning cord 130. The pulley 338A is coupled to the frame 110 adjacent the second frame end 118 via a spring 340A and a coupling plate 364A. FIG. 14*a* is a simplified left-side schematic view of the roller shade system 300 showing the interaction between the shade fabric 120, the roller tube 122, the hembar 124, the tensioning cord 130, the pulleys 338A, and the spring 340A. The spring 340A is oriented in the reverse direction as in the roller shade systems 100, 200 of the first and second embodiments (e.g., rotated approximately 180°). Accordingly, the length of travel of the hembar 124 through hembar slots 352A, 352B of the roller shade system 300 according to the third embodiment is smaller than the length of travel of the hembar in roller shades systems 100, 200 of the first and second embodiments.

While the frame 110 of the roller shade systems 100, 200, 300 was described in the present application and shown in the figures as a substantially square frame having four sides, the present invention is not limited to square frames having four sides. For example, the frame 110 could have a rectangular shape. Further, the frame 110 could only three sides, for example, having the second frame end 118 removed.

Figure 15:
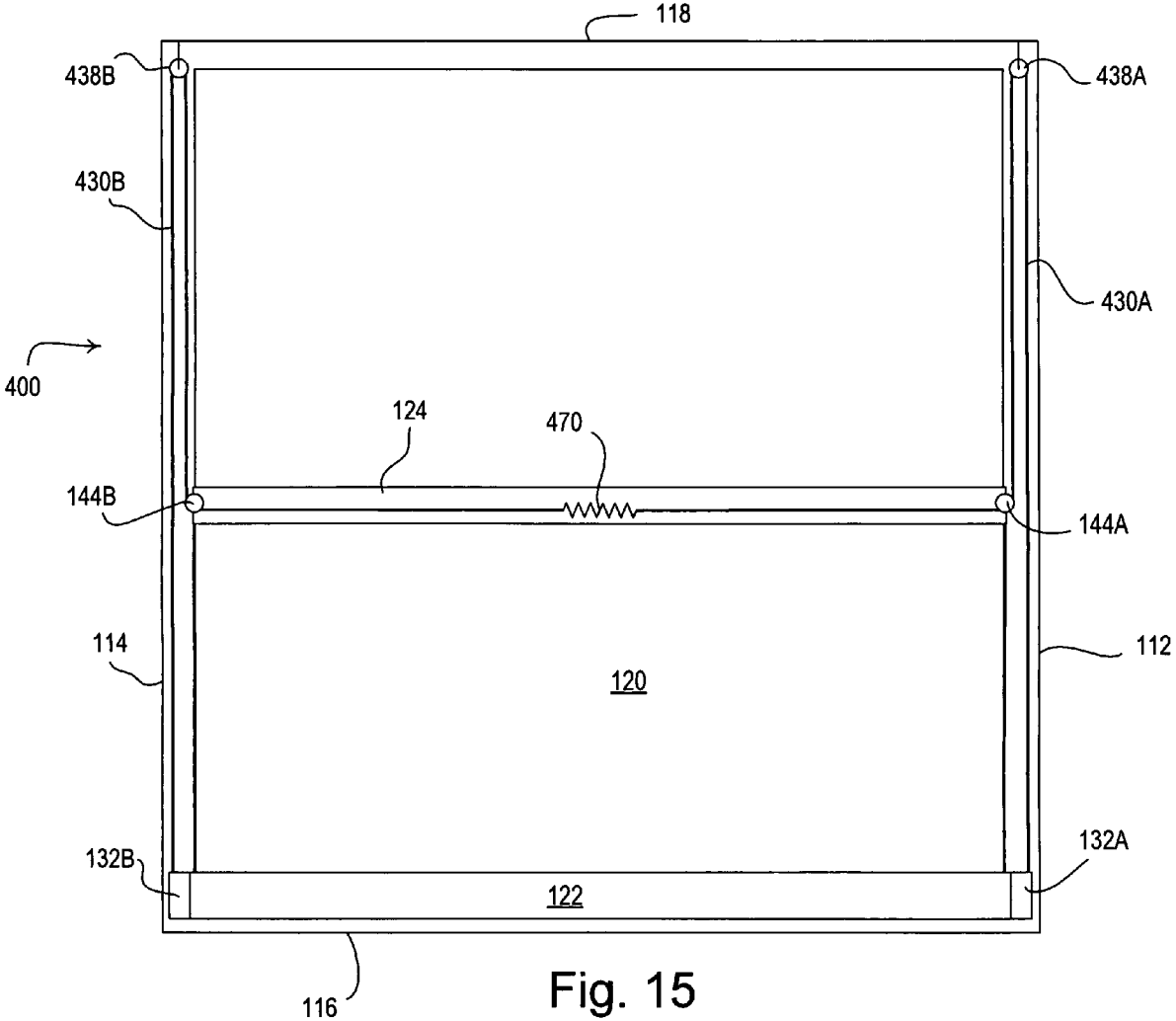
FIG. 15 is a simplified front schematic view of a roller shade system according to a fourth embodiment of the present invention.

As described above, the roller shade system 100, 200, 300 is tensioned by springs 140A, 140B located in and attached to the side channels 112, 114. However, the locations of the springs of the present invention are not limited to the side channels 112, 114. FIG. 15 is a simplified front schematic view of a roller shade system 400 according to a fourth embodiment of the present invention. The roller shade system 400 includes two separate tensioning cords (i.e., first and second tensioning cord portions 430A, 430B), which are windingly received around respective pulleys 438A, 438B in the respective side channels 112, 114. A single spring 470 is located inside the hembar 124 and is coupled between the first and second tensioning cord portions 430A, 430B to provide for the appropriate tensioning of the roller shade system 400. An example of a roller shade system having a spring located inside the hembar is described in greater detail in U.S. Pat. No. 1,121,898, issued Dec. 22, 1914, entitled WINDOW SCREEN, the entire disclosure of which is hereby incorporated by reference.

Figure 16:
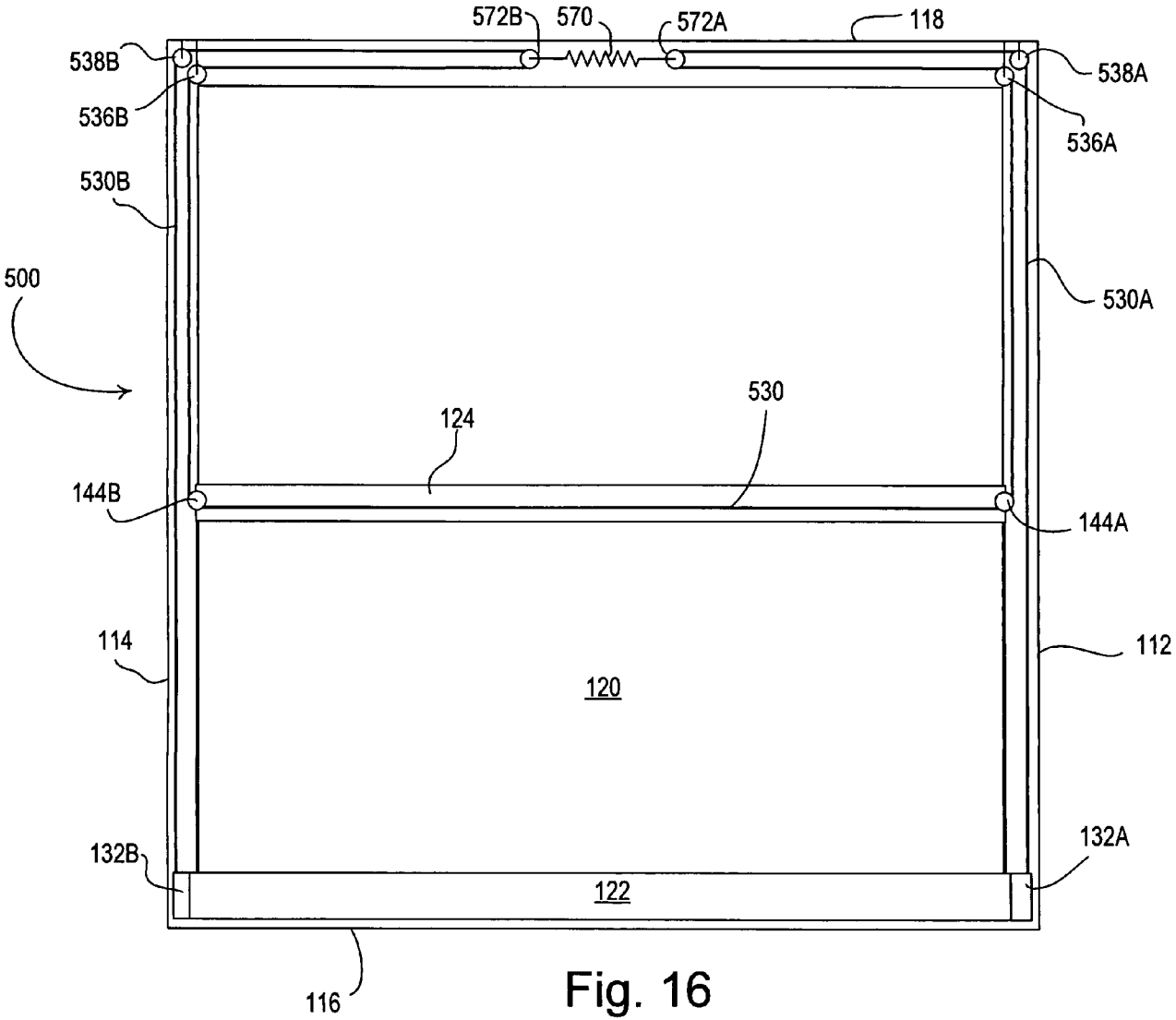
FIG. 16 is a simplified front schematic view of a roller shade system according to a fifth embodiment of the present invention.

FIG. 16 is a simplified front schematic view of a roller shade system 500 according to a fifth embodiment of the present invention. In the roller shade system 500, first and second tensioning cord portions 530A, 530B are formed as part of a single tensioning cord (i.e., tensioning cord 530). The roller shade system 500 comprises a single spring 570, which is located in the second frame end 118 and has a first spring pulley 572A at a first spring end and a second spring pulley 572B at a second spring end. The roller shade system 500 further comprises two pulleys 536A, 538A located in the first side channel 112 adjacent the second frame end 118, and two pulleys 536B, 538B located in the second side channel 114 adjacent the second frame end. The pulleys 536A, 538A in the first side channel 112 operate to guide the first tensioning cord portion 530A towards the first spring pulley 572A, which windingly receives the first tensioning cord portion. The pulleys 536B, 538B in the second side channel 114 operate to guide the second tensioning cord portion 530B towards the second spring pulley 572B, which windingly receives the second tensioning cord portion. Since the spring 570 is located in the second frame end 118, the spring may be sized appropriately large to accommodate for different thicknesses and surface areas of the shade fabric 120 received around the roller tube 122.

Alternatively, two separate springs (not shown) could be included in the second frame end 118 rather than the single spring 570. Both springs would be coupled to the second frame end 118 at first spring ends and comprises pulleys at second spring ends. The pulley of one spring would windingly receive the first tensioning cord portion 530A, while the pulley of the other spring would windingly receive the second tensioning cord portion 530B. A single tensioning cord or two separate tensioning cords could be used.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A self-contained tensioned roller shade system adapted to be mounted in an opening having first and second opposite sides, and third and fourth opposite sides, the roller shade system comprising:

a free-standing frame having first and second spaced-apart parallel side channels adapted to be mounted along the first and second opposite sides of the opening, respectively, each of the side channels having a proximal end and a distal end, the frame having a first frame end coupled between the proximal ends of the side channels and adapted to be mounted along the third side of the opening;

a roller tube rotatably mounted between the proximal ends of the first and second side channels adjacent the first frame end;

a shade fabric having a first fabric end connected to the roller tube, such that the shade fabric is windingly received around the roller tube, the shade fabric having a second fabric end opposite the first fabric end;

a first pulley located in the first side channel and operatively coupled to the frame adjacent the distal end of the first side channel; and a first tensioning cord operatively coupled between the roller tube and the second fabric end, the tensioning cord coupled to the roller tube for winding receipt about the roller tube, the tensioning cord windingly received around the first pulley, the tensioning cord adapted to bias the second fabric end toward the distal ends of the side channels, such that the shade fabric and the tensioning cord apply forces on the frame;

wherein the second fabric end is adapted for translational movement between the distal ends and the proximal ends of the first and second side channels as the roller tube is rotated; and wherein the free-standing frame contains the forces applied by the shade fabric and the tensioning cord to minimize the forces applied by the frame on the opening in which the roller shade system is mounted.

2. The system of claim 1, wherein the tensioning cord is spring-biased to pull the second fabric end toward the distal ends of the side channels.

3. The system of claim 2, further comprising:

a hembar connected to the shade fabric at the second fabric end, the hembar having a first hembar end received by the first side channel and a second hembar end received by the second side channel.

4. The system of claim 3, further comprising:

a second pulley located in the second side channel and operatively coupled to the frame adjacent the distal end of the second side channel.

5. The system of claim 4, wherein the roller tube comprises a first tube end coupled to the first side channel and a second tube end coupled to the second side channel, the tensioning cord comprising a first cord end and a second cord end, the first cord end coupled to the roller tube at the first tube end for winding receipt about the roller tube at the first tube end, the second cord end coupled to the roller tube at the second tube end for winding receipt about the roller tube at the second tube end, the tensioning cord extending through the hembar and windingly received around the first and second pulleys.

6. The system of claim 5, further comprising:

a first spring coupled to the frame and located in the first side channel, the first spring operatively coupled to the tensioning cord, such that the cord is spring-biased to pull the second fabric end toward the distal ends of the side channels.

7. The system of claim 6, further comprising:

a second spring coupled to the frame and located in the second side channel, the second spring operatively coupled to the tensioning cord.

8. The system of claim 5, further comprising:

a spring located in the second frame end of the frame, and having a first spring end operatively coupled to a first portion of the tensioning cord in the first side channel and a second spring end operatively coupled to a second portion of the tensioning cord in the second side channel.

9. The system of claim 8, wherein the spring comprises a first spring pulley at the first spring end and a second spring pulley at the second spring end, the first portion of the tensioning cord windingly received around the first spring pulley, the second portion of the tensioning cord windingly received around the second spring pulley.

10. The system of claim 4, wherein the first tensioning cord is coupled between a first tube end of the roller tube and the first hembar end, the first tensioning cord coupled to the roller tube for winding receipt about the roller tube at the first tube end, the system further comprising:

a second tensioning cord coupled between a second tube end of the roller tube and the second hembar end, the second tensioning cord coupled to the roller tube for winding receipt about the roller tube at the second tube end, the second tensioning cord windingly received around the second pulley.

11. The system of claim 10, further comprising:

a first spring operatively coupled to the frame and located in the first side channel, the first spring operatively coupled to the first tensioning cord;

a second spring operatively coupled to the frame and located in the second side channel, the second spring operatively coupled to the second tensioning cord.

12. The system of claim 10, further comprising:

a spring located in the hembar and operatively coupled between the first and second tensioning cords.

13. The system of claim 3, wherein the first and second side channels include respective first and second hembar slots, the hembar having first and second hembar ends having respective first and second hembar wheels received within the respective first and second hembar slots; and wherein the first and second side channels each include first and second flanges and an interior wall between the first and second flanges, wherein the first and second slots are formed between the first flange and the wall of each side channel, the first and second slots each defining a sidewall between the respective first flange and the respective interior wall, each sidewall having a non-planar surface to allow for rolling contact with the sides of the respective wheels of the hembar.

14. The system of claim 2, further comprising:

a spring located in the first side channel, coupled to the frame, and operatively coupled to the tensioning cord, such that the second fabric end is biased towards the distal ends of the side channels.

15. The system of claim 14, further comprising:

a second pulley located in the first side channel, mounted to the frame adjacent the distal end of the first side channel, and windingly receiving the tensioning cord; and a third pulley located in the first side channel, coupled to the spring, and windingly receiving a portion of the tensioning cord between the portions of the tensioning cord received by the second and third pulleys.

16. The system of claim 14, wherein the spring is coupled between the first pulley and the frame.

17. The system of claim 14, further comprising:

a tensioning adjustment screw coupled to the spring for adjusting the force exerted by the spring on the tensioning cord.

18. The system of claim 2, wherein the frame has a second frame end coupled between the distal ends of the side channels and adapted to be mounted along the third side of the opening, the shade fabric and the first tensioning cord applying forces on the first and second frame ends to pull the frame ends towards each other, the free-standing frame containing the forces applied on the first and second frame ends by the shade fabric and the first tensioning cord.

19. The system of claim 18, wherein the frame is substantially rectangular.

20. The system of claim 2, further comprising:

a motor drive unit coupled to the roller tube for rotating the roller tube.

21. A self-contained tensioned roller shade system comprising:

a free-standing frame having first and second opposite sides defining respective first and second side channels, and third and fourth opposite sides defining respective first and second frame ends;

a roller tube having a first tube end rotatably mounted to the first side channel and a second tube end rotatably mounted to the second side channel, the roller tube mounted adjacent the first frame end;

a shade fabric having a first fabric end connected to the roller tube, such that the shade fabric is windingly received around the roller tube, the shade fabric having a second fabric end opposite the first fabric end;

a hembar connected to the shade fabric at the second fabric end, the hembar having a first hembar end received by a first hembar slot of the first side channel and a second hembar end received by a second hembar slot of the second side channel, the first and second hembar ends having respective first and second hembar wheels received within the respective first and second hembar slots;

a first pulley operatively coupled to the frame adjacent the second frame end and located in the first side channel;

a second pulley operatively coupled to the frame adjacent the second frame end and located in the second side channel;

a first tensioning cord portion operatively coupled between the first tube end of the roller tube and the first hembar end of the hembar, the first tensioning cord portion coupled to the roller tube for winding receipt about the first tube end of the roller tube, the first tensioning cord portion windingly received around the first pulley;

a second tensioning cord portion operatively coupled between the second tube end of the roller tube and the second hembar end of the hembar, the second tensioning cord portion coupled to the roller tube for winding receipt about the second tube end of the roller tube, the second tensioning cord portion windingly received around the second pulley; and a first spring coupled to the frame and located within the first side channel, the first spring operatively coupled to the first tensioning cord portion, such that the hembar is biased towards the second frame end, and the hembar adapted to move between the first and second frame ends as the roller tube is rotated;

wherein the first and second side channels each include respective flanges and interior walls, the first and second hembar slots formed between the flange and the interior wall of each side channel, the first and second hembar slots each defining a sidewall between the respective flange and the respective interior wall, each sidewall having a non-planar surface to allow for rolling contact with the sides of the respective wheels of the hembar.

22. The system of claim 21, wherein the first and second tensioning cord portions are part of a single tensioning cord, the single tensioning cord comprising a first cord end coupled to the roller tube at the first tube end for winding receipt about the roller tube at the first tube end, the tensioning cord comprising a second cord end coupled to the roller tube at the second tube end for winding receipt about the roller tube at the second tube end, the tensioning cord extending through the hembar and windingly received around the first and second pulleys.

23. The system of claim 22, further comprising:

a first spring coupled to the frame and located in the first side channel, the first spring operatively coupled to the tensioning cord, such that the tensioning cord is spring-biased to pull the second fabric end toward the second frame end.

24. The system of claim 23, further comprising:

a second spring coupled to the frame and located in the second side channel, the second spring operatively coupled to the tensioning cord.

25. The system of claim 21, wherein the first and second tensioning cord portions are part of separate tensioning cords, the system further comprising:

a second spring coupled to the frame and located within the second side channel, the second spring operatively coupled to the second tensioning cord portion.

26. A self-contained tensioned roller shade system comprising:

a free-standing frame having first and second opposite sides defining respective first and second side channels, and third and fourth opposite sides defining respective first and second frame ends;

a roller tube having a first tube end rotatably mounted to the first side channel and a second tube end rotatably mounted to the second side channel, the roller tube mounted adjacent the first frame end;

a shade fabric having a first fabric end connected to the roller tube, such that the shade fabric is windingly received around the roller tube, the shade fabric having a second fabric end opposite the first fabric end;

a hembar connected to the shade fabric at the second fabric end, the hembar having a first hembar end received by a first hembar slot of the first side channel and a second hembar end received by a second hembar slot of the second side channel, the first and second hembar ends having respective first and second hembar wheels received within the respective first and second hembar slots;

a tensioning cord comprising a first cord end coupled to the roller tube at the first tube end for winding receipt about the roller tube at the first tube end, the tensioning cord comprising a second cord end coupled to the roller tube at the second tube end for winding receipt about the roller tube at the second tube end, the tensioning cord extending through the hembar;

first, second, third, and fourth pulleys connected to the frame adjacent the second frame end, the first and second pulleys located within the first side channel, the third and fourth pulleys located within the second side channel, the tensioning cord windingly received around the first, second, third, and fourth pulleys;

first and second springs operatively coupled to the frame and located within the first and second side channels, respectively;

a fifth pulley coupled to the first spring and located within the first side channel, the fifth pulley windingly receiving a portion of the tensioning cord between the portions of the tensioning cord received by the first and second pulleys; and a sixth pulley coupled to the second spring and located within the second side channel, the sixth pulley windingly receiving a portion of the tensioning cord between the portions of the tensioning cord received by the third and fourth pulleys;

wherein the hembar is biased towards the second frame end, and the hembar is adapted to move between the first and second frame ends as the roller tube is rotated; and wherein the first and second side channels each include respective flanges and interior walls, the first and second hembar slots formed between the flange and the interior wall of each side channel, the first and second hembar slots each defining a sidewall between the respective flange and the respective interior wall, each sidewall having a non-planar surface to allow for rolling contact with the sides of the respective wheels of the hembar.

27. A roller shade system adapted to be mounted in an opening having first and second opposite sides, and third and fourth opposite sides, the roller shade system comprising:

a free-standing frame having first and second side channels adapted to be mounted along the first and second opposite sides of the opening, respectively, and first and second frame ends adapted to be mounted along the third and fourth opposite sides of the opening, respectively;

a roller tube adapted to be windingly mounted between the first and second side channels adjacent the third side of the opening;

a shade fabric having a first fabric end connected to the roller tube, such that the shade fabric is windingly received around the roller tube, the shade fabric having a second fabric end opposite the first fabric end;

a tensioning cord operatively coupled between the roller tube and the second fabric end, the tensioning cord coupled to the roller tube for winding receipt about the roller tube;

a pulley located within the first side channel and adapted to be operatively coupled to the frame adjacent the fourth side of the opening, the pulley windingly receiving the tensioning cord; and a spring coupled to the frame and located within the first side channel, the first spring operatively coupled to the tensioning cord, such that the second fabric end is biased towards the fourth side of the opening, and the shade fabric and the tensioning cord apply forces on the first and second frame ends to pull the frame ends towards each other, the second fabric end of the shade fabric adapted to move between the third and fourth sides of the opening as the roller tube is rotated;

wherein the free-standing frame contains the forces applied on the first and second frame ends by the shade fabric and the tensioning cord to minimize the forces applied by the frame on the opening in which the roller shade system is mounted.

28. A method of installing a self-contained tensioned roller shade system in an opening, the method comprising the steps of:

providing a free-standing frame having first and second opposite sides defining respective first and second side channels, and third and fourth opposite sides defining respective first and second frame ends;

mounting a roller tube between the first and second side channels of the frame adjacent the first frame end, such that the roller tube is operable to rotate;

connecting a first fabric end of a shade fabric to the roller tube, such that the shade fabric is windingly received around the roller tube;

coupling a tensioning cord to the roller tube for winding receipt about the roller tube;

coupling the tensioning cord to a pulley operatively coupled to the frame adjacent the second frame end, such that the tensioning cord is windingly received around the pulley;

operatively coupling the tensioning cord to a second fabric end opposite the first fabric end of the shade fabric;

connecting a spring between the pulley and the frame;

biasing the second fabric end towards the second frame end, such that the shade fabric and the tensioning cord apply forces on the frame;

adjusting the amount of force applied to the tensioning cord by the spring; and subsequently installing the frame into the opening, such that the free-standing frame contains the forces applied by the shade fabric and the tensioning cord to minimize the forces applied by the frame on the opening in which the roller shade system is mounted;

wherein the second fabric end of the shade fabric is adapted to move between the first and second frame ends as the roller tube is rotated.

29. The system of claim 21, wherein the shade fabric and the tensioning cords apply forces on the first and second frame ends to pull the frame ends towards each other, the free-standing frame containing the forces applied on the first and second frame ends by the shade fabric and the tensioning cords.

30. The system of claim 26, wherein the shade fabric and the first tensioning cord apply forces on the first and second frame ends to pull the frame ends towards each other, the free-standing frame containing the forces applied on the first and second frame ends by the shade fabric and the tensioning cords.

* * * * *